US008364065B2

(12) United States Patent
Bisaiji et al.

(10) Patent No.: US 8,364,065 B2
(45) Date of Patent: Jan. 29, 2013

(54) IMAGE FORMING APPARATUS AND IMAGE FORMING SYSTEM

(75) Inventors: Takashi Bisaiji, Kanagawa (JP); Yasutada Shitara, Shizuoka (JP); Hijiri Ogata, Miyagi (JP); Haruki Saitoh, Miyagi (JP)

(73) Assignees: Ricoh Company, Ltd., Tokyo (JP); Tohoku Ricoh Co., Ltd., Miyagi (JP)

( * ) Notice: Subject to any disclaimer, the term of this patent is extended or adjusted under 35 U.S.C. 154(b) by 318 days.

(21) Appl. No.: 12/923,271

(22) Filed: Sep. 13, 2010

(65) Prior Publication Data

US 2011/0064489 A1 Mar. 17, 2011

(30) Foreign Application Priority Data

Sep. 14, 2009 (JP) ..... 2009-211773

(51) Int. Cl.
*G03G 15/20* (2006.01)

(52) U.S. Cl. ..... 399/324; 399/325; 399/341

(58) Field of Classification Search ..... 399/122, 399/123, 320, 324–326, 341
See application file for complete search history.

(56) References Cited

U.S. PATENT DOCUMENTS

| | | | | |
|---|---|---|---|---|
| 5,124,225 | A | 6/1992 | Shibata | |
| 7,310,492 | B2 * | 12/2007 | Kimura | 399/325 |
| 7,734,237 | B2 * | 6/2010 | Mukai | 399/307 |

FOREIGN PATENT DOCUMENTS

| | | |
|---|---|---|
| JP | 62-100775 | 5/1987 |
| JP | 03-168649 | 7/1991 |
| JP | 03-091764 | 4/1994 |
| JP | 08-334919 | 12/1996 |
| JP | 10-274909 | 10/1998 |

OTHER PUBLICATIONS

"*Electrophotography—Bases and Application*", First Edition, Corona Publishing, Jun. 15, 1988, (pp. 321-324), Partial English Translation.

* cited by examiner

*Primary Examiner* — Hoan Tran
(74) *Attorney, Agent, or Firm* — Harness, Dickey & Pierce, P.L.C.

(57) ABSTRACT

An image forming apparatus is disclosed, including: a toner image forming unit which forms a toner image on a surface of a transfer material, the toner image being an image formed of toner, the toner containing wax; a fixing device which fixes the toner image using a fixing member on which a mold release agent including oil is applied; and a surface processing device which processes the fixed surface of the transfer material, on which surface the toner image is fixed using the fixing member on which the mold release agent including the oil is applied, wherein the surface processing device further includes a discharging unit which generates a discharge on or near the fixed surface of the transfer material, on which surface the fixed toner image is formed.

15 Claims, 21 Drawing Sheets

TRANSFER PAPER X

TRANSFER PAPER Y

IMAGE FORMING APPARATUS AND IMAGE FORMING SYSTEM

TECHNICAL FIELD

The present invention relates to image forming apparatuses and image forming systems that have a surface processing device which processes a surface of a transfer material.

BACKGROUND ART

In the related art, an electronic photography type image processing device implementing the Carlson process is known. In this image forming device, in general, a photoconductive photoreceptor is uniformly charged; a latent image is produced as a charge distribution by an image exposure that depends on an image pattern; and the latent image on the photoreceptor is manifested with a toner, which is a resin colored fine particle charged positive or negative. Thereafter, the toner image on the photoreceptor is transferred onto a surface of a transfer material such as a transfer paper by an electrostatic force, the toner image is fixed onto the transfer material using an elasticity of the toner by passing it through rollers to which pressure is applied, making it possible to obtain a final toner image. It is common to use thermal energy for a toner fixing unit which uses the elasticity of the toner to fix the toner.

In the toner fixing unit which uses the thermal energy, the toner image on the transfer material and a surface of a fixing member which includes a heated roller, etc., may come into direct contact, possibly causing an offset phenomenon such that a part of the toner image adheres to the surface of the fixing member or a winding phenomenon such that the transfer material winds itself at the transfer material. A method is known that, in order to prevent the above-described winding phenomenon of the transfer material and the offset phenomenon, a mold release layer of Teflon (a registered trademark) or of silicone is provided on the surface of the fixing member, and oil as the mold release layer (for example, Silicone oil) is applied to the surface of the fixing member (See Non-patent document 1, for example). Moreover, a method is known that, a toner to which a wax as a mold release agent is added is used to form an image in order to be able to decrease the amount of oil applied to the surface of the fixing member or to do away with the oil application itself (see Non-patent documents 1-4).

In recent years, improvements in the speed and the quality of the above-described image forming devices using the electronic photography method have been advancing, and peripheral devices which process paper are also being enhanced. Moreover, for the image forming devices using the electronic photography method, it is not necessary to make a die plate. For these reasons, the image forming device using the electronic photography method is starting to be used in an area in which a related art printing machine such as an offset, etc., is being used as a print on demand (below called "POD") unit. For use as such a POD unit, in order to provide added value by post processing to a transfer material as a printed matter, a coating processing such that varnish is applied to the fixed surface of the transfer material or a coating processing of film, etc., which is represented by PP (polypropylene) laminating, may be carried out. By such a processing of coating the film or the varnish, added value may be obtained such as a prevention of rubbing or cracking, or a sense of quality due to a highly gloss finish. However, when the processing of coating the varnish or film is carried out on a fixed transfer material output from the image forming device using the above-described electronic photography method (the POD unit), oil or wax for obtaining the above-mentioned mold releasability may have an effect on unevenness of the varnish applied onto the transfer material and adhesiveness between the transfer material and the film. In other words, the oil or the wax as the mold release agent exists on the fixed surface of the transfer material, so that a phenomenon may occur such that an adhesive of the varnish or the film is repelled and the varnish cannot be applied uniformly, or that a certain level of adhesiveness cannot be obtained between the transfer material and the film.

In order to avoid such a phenomenon as described above, it is possible that the transfer material is left as it is until the oil which exists on the surface of the transfer material decreases due to immersion, etc., or alternatively, a special adhesive or varnish to which a surfactant or alcohol is added is used. However, an inefficient operation such as leaving the transfer material as it is could lead to a drop in operational efficiency, and the use of the special varnish or adhesive could lead to an increased cost.

Moreover, there is also a problem that, when there exists oil or wax as the mold release agent on the fixed surface of the transfer material output from the image forming device using the electronic photography method as described above, it is difficult to seal on or add with writing instruments onto the fixed surface of the transfer material, so that it is not possible to obtain satisfactory correctivity.

Patent Documents

Patent document 1: JP62-100775A

Patent document 2: JP3-91764A

Patent document 3: JP3-168649A

Patent document 4: JP8-334919A

Non-Patent Document

Non-patent document Institute of Electronic Photography, "Basics and Applications of Electronic Photography Techniques", First Edition, Corona Publishing, Jun. 15, 1988, pp. 321-324.

DISCLOSURE OF THE INVENTION

The present invention has been made in view of the above-described problems. The object of the present invention is to provide an image forming apparatus and an image forming system that make it possible to carry out a process of coating a varnish or a film onto the fixed surface of the transfer material, onto which surface the toner image is fixed, while avoiding a drop in operational efficiency, and to obtain an improved correctivity on the fixed surface of the transfer material.

According to an embodiment of the present invention, an image forming apparatus is provided, including a toner image forming unit which forms a toner image on a surface of a transfer material, the toner image being an image formed of toner, the toner containing wax;

a fixing device which fixes the toner image using a fixing member on which a mold release agent including oil is applied; and a surface processing device which processes the fixed surface of the transfer material, on which surface the toner image is fixed using the fixing member on which the mold release agent including the oil is applied, wherein the surface processing device further includes a discharging unit which generates a discharge on or near the fixed surface of the transfer material, on which surface the fixed toner image is formed.

The embodiment of the present invention makes it possible to carry out a process of coating a varnish or a film onto the fixed surface of the transfer material, onto which surface the toner image is fixed, while avoiding a drop in operational efficiency, and to obtain an improved correctivity on the fixed surface of the transfer material.

BRIEF DESCRIPTION OF THE DRAWINGS

Other objects, features, and advantages of the present invention will become more apparent from the following detailed descriptions when read in conjunction with the accompanying drawings, in which:

FIG. 5 is an explanatory diagram illustrating how an additive such as the wax, etc., that is added to the toner looks like;

BEST MODE FOR CARRYING OUT THE INVENTION

The present invention is not limited to the specifically disclosed embodiments, but variations and modifications may be made without departing from the scope of the present invention.

A description is given below with regard to embodiments of the present invention with reference to the drawings.

Figure 1:
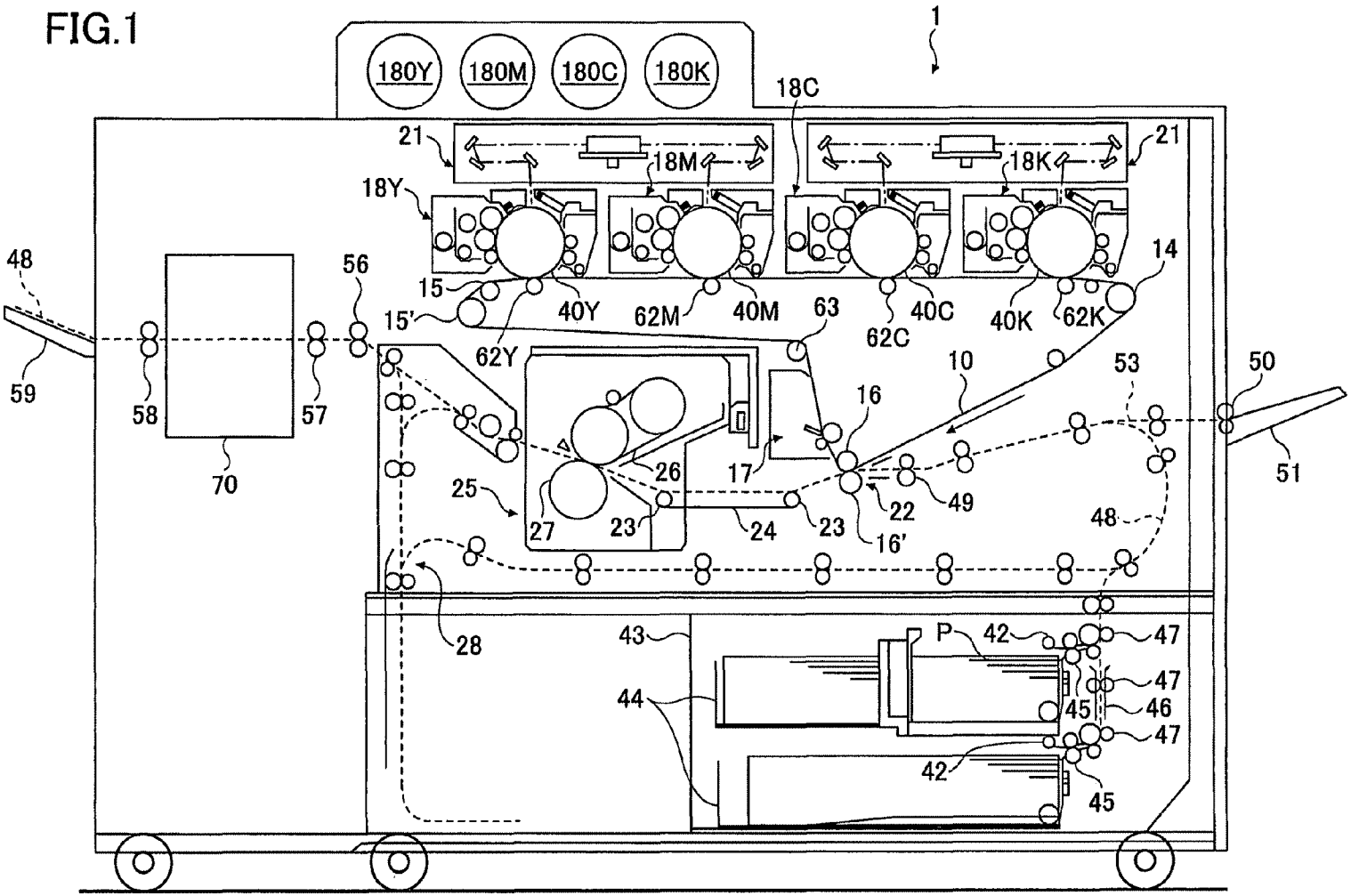
FIG. 1 is a schematic configuration diagram of an image forming device according to an embodiment of the present invention.

FIG. 1 is a schematic configuration diagram of an image forming device according to an embodiment of the present invention. The image forming device 1 of the present embodiment is a full-color image forming device, which can form a full-color image using electronic photography, may be used as a full-color POD unit.

The image forming device 1 of the present embodiment includes two optical writing units 21, and process units 18Y, M, C, and K as four toner image forming units which form respective toner images of yellow (Y), magenta (M), cyan (C), and black (K). Moreover, the image forming device 1 further includes a pair of regist rollers 49, a manual feeding roller 50, a manual tray 51, a manual paper feeding channel 53, a conveying switching device 28, a fixed paper discharging roller pair 56, a conveying roller pair 57 and 58 which conveys a fixed transfer paper P to be surface processed, and a paper-discharge tray 59 as a transfer material output section, etc. such that a transfer paper conveying channel 48 is formed on which a transfer paper P as a transfer material that is supplied from a paper feeding section 43 which has two paper-feeding cassettes 44 is conveyed and output. Furthermore, the image forming device 1 further includes an intermediate transfer unit which transfers onto a transfer paper P via an intermediate transfer belt 10 as an intermediate transfer body a toner image formed by the process units 18Y, 18M, 18C and 18K; a fixing device 25 as a fixing unit which fixes a toner image onto the transfer paper P; a conveying belt unit which conveys, to the fixing device 25 via a conveying belt 24 wired to a supporting roller 23, the transfer paper P onto which the toner image is transferred by the intermediate transfer unit; and a transfer paper resending device for forming a toner image on both faces of the transfer paper P. Then, the image forming device 1, as described in detail below, further includes a surface processing device 70 which processes the fixed surface of the transfer paper P output from the fixing device 25.

Each paper-supplying cassette 44 respectively carries a bundle of transfer paper sheets P, and a topmost transfer paper sheet P in a paper bundle of the paper-supplying cassette 44 is sent out as the paper-supplying roller 42 is rotationally driven. The transfer paper sent out from the paper-supplying cassette 44 is conveyed to the transfer paper conveying channel 48 by the paper-supplying rollers 45, 47, and the paper-supplying channel 46. The manual tray 51 on a side face of a housing is provided such that it can be opened and closed with respect to the housing, so that a paper bundle is manually fed onto an upper face with the manual tray 51 being opened with respect to the housing. The topmost transfer paper in the manually fed paper bundle is sent out to the transfer paper conveying channel 48 by the manual feeding roller 50.

The two optical writing units 21, each of which has a laser diode, a polygon mirror, various lenses, etc., drive a light source such as a semiconductor laser (LD), etc., based on image information sent from an external device such as a computer device, etc., or on image information read by an external image reading device (scanner) to optically scan photoreceptors 40Y, 40M, 40C, and 40K of the process units 18Y, 18M, 18C, and 18K. More specifically, each of the photoreceptors 40Y, 40M, 40C, and 40K of the process units 18Y, 18M, 18C, and 18K is rotationally driven in a counterclockwise direction shown by a driving unit (not shown). The optical writing unit 21 shown on the left side performs the optical scanning process by irradiating the rotationally-driven photoreceptors 40Y and 40M with a laser beam while deflecting them in a rotational axis direction. In this way, an electrostatic latent image based on Y and M image information is formed on the photoreceptors 40Y and 40M, respectively. Moreover, the optical writing unit 21 shown on the right side performs the optical scanning process by irradiating the rotationally-driven photoreceptors 40C and 40K with the laser beam while deflecting them in the rotational axis direction. In this way, an electrostatic latent image based on C and K image information is formed on the photoreceptors 40C and 40K, respectively.

The four process units 18Y, 18M, 18C, and 18K have respectively drum-shaped photoreceptors 40Y, 40M, 40C, and 40K as a latent image bearing body. Moreover, the process units 18Y, 18M, 18C, and 18K respectively support, in a common supporting body as one unit, various equipment units which are arranged in the surroundings of the photoreceptors 40Y, 40M, 40C, and 40K, which equipment units are removable with respect to the image forming device body. Each of the process units 18Y, 18M, 18C, and 18K has the same configuration except that the color of the toner used is different among one another. The image forming device 1 according to the present embodiment is configured in a so-called tandem fashion such that these four process units 18Y, 18M, 18C, and 18K are lined up along the endless moving direction so that they oppose a stretching section between supporting rollers of the intermediate transfer belt 10.

Taking, as an example, the process unit 18Y which forms the toner image of yellow (Y), the process unit 18Y has, besides a photoreceptor 40Y, a developing device for developing, onto the Y toner image, an electrostatic latent image formed on the surface. Moreover, it has a charging device which applies a uniform charging process on a surface of the photoreceptor 40Y which is rotationally driven and a drum cleaning device, etc., which cleans untransferred toner adhered to the photoreceptor 40Y surface after passing through an initial transfer nip for Y. The charging device, the developing device, and the drum cleaning device are arranged such that they are lined up in a rotational direction of the photoreceptor 40Y in that order.

As the photoreceptor 40Y, a drum-shaped one is used such that an element tube such as an aluminum tube is formed with a photosensitive layer by applying an organic photosensitive material. An endless-belt shaped one is also used.

The developing device for Y uses a two-component developer (below called merely "a developer") which contains a non-magnetic Y toner and a magnetic carrier (not shown) to develop a latent image. As the developing device, a type of developing device which develops using a one-component developer which does not contain a magnetic carrier may be used in lieu of the two-component developer. To the developing device, a Y toner within a Y toner bottle 180Y is appropriately replenished by a Y toner replenishing device (not shown). The toner which can be used for each of the process units 18Y, 18M, 18C, and 18K is exemplified later.

While, for the drum cleaning device for Y, a scheme is used of pushing, against the photoreceptor 40Y, a polyurethane rubber-made cleaning blade, which is a cleaning member, a different scheme may be used. Moreover, for the present image forming device, for the purpose of enhancing cleanability, a scheme is adopted of abutting a rotatable fur brush against the photoreceptor 40Y. The fur brush also serves to rake out a lubricant from a solid lubricant (not shown) to produce a fine powder and at the same time apply the produced fine powder onto the surface of the photoreceptor 40Y.

On the upper part of the photoreceptor 40Y is provided a static eliminating lamp (not shown), and the static eliminating lamp is also arranged to be a part of the process unit 40Y. The static eliminating lamp eliminates, by light irradiation, static on the surface of the photoreceptor 40Y after passing through the drum cleaning device. The surface of the photoreceptor 40Y from which static is eliminated undergoes optical scanning by the above-described optical writing unit 21 for YM after it is uniformly charged by a charging device. The charging device is rotationally driven while being supplied a charge bias from a power supply (not shown). In lieu of the scheme as described above, a Scorotron charger method may be adopted which performs the charging process without contacting the photoreceptor 40Y.

While the process unit 18Y for Y has been described in the foregoing, the process units 40M, 40C, and 40K for M, C, and K also have the same configuration as that for Y.

On the lower part of the four process units 40Y, 40M, 40C, and 40K is provided the intermediate transfer unit. The intermediate transfer unit abuts, against the photoreceptors 40Y, 40M, 40C, and 40K, an intermediate transfer belt 10 which is wired and stretched across multiple rollers 14, 15, 15', 16, and 63, and, at the same time, endlessly moves the intermediate transfer belt 10 in the clockwise direction shown as any one roller is rotationally driven. In this way, primary transfer nips for Y, M, C, and K are formed for the photoreceptors 40Y, 40M, 40C, and 40K to abut against the intermediate transfer belt 10.

Near each of the primary transfer nips for Y, M, C, and K, the intermediate transfer belt 10 is pressed to the photoreceptors 40Y, 40M, 40C, and 40K by primary transfer rollers 62Y, 62M, 62C, and 62K as a primary transfer member provided inside a belt loop. To these primary transfer rollers 62Y, 62M, 62C, and 62K is applied a primary transfer bias by a power supply (not shown). In this way, a primary transfer electric field is formed which electrostatically moves a toner image on the photoreceptors 40Y, 40M, 40C, and 40K to the intermediate transfer belt 10.

Toner images are successively overlapped and undergo primary transferring by each primary transfer nip onto a front face of the intermediate transfer belt 10 which successively passes through the primary transfer nip for Y, M, C, and K with an endless movement in the clockwise direction shown. With the overlapped primary transferring, a four-color overlapped toner image (below called "a four-color toner image") is formed on the front face of the intermediate transfer belt 10.

A secondary transfer roller 16' as a secondary transfer member is provided at a secondary transfer section 22 in the lower part of intermediate transfer belt 10 shown. This secondary transfer roller 16' abuts, from the front face of the belt, against where it is wound to a secondary transfer back up roller 16 at the intermediate transfer belt 10 to form a secondary transfer nip. In this way, the secondary transfer nip is formed, where the front face of the intermediate transfer belt 10 abuts against the secondary transfer roller 16'.

A secondary transfer bias is applied to the secondary transfer roller 16' with a power supply (not shown). On the other hand, a secondary transfer back up roller 16 within a belt loop is grounded. In this way, a secondary transfer electric field is formed within the secondary transfer nip.

On the right lateral side shown of the secondary transfer section 22 is provided the above-described regist roller pair 49, when transfer paper P placed between the rollers is sent out to the second transfer nip at a timing such that it may be synchronized to a four color toner image on the intermediate transfer belt 10. Within the secondary transfer nip, the four color toner image on the intermediate transfer belt 10 undergo secondary transferring as a whole onto the transfer paper P due to an effect of the secondary transfer electric field and nip pressure, and combines with a white color of the transfer paper P to become a full color image.

Untransferred toner which has not been transferred to the transfer paper P at the secondary transfer nip adheres to the front face of the intermediate transfer belt 10 which passed the secondary transfer nip. The untransferred toner is cleaned by a belt cleaning device 17 which abuts against the intermediate transfer belt 10.

The transfer paper P which passed through the secondary transfer nip separates from the intermediate transfer belt 10 so as to be passed onto the conveying belt unit. This conveying belt unit endlessly moves an endless-shaped conveying belt 24 in the shown counterclockwise direction as a driving roller rotationally drives while it is being stretched by two rollers (the driving roller and a follower roller) 23. Then, the transfer paper P passed on from the secondary transfer nip is conveyed as the conveying belt 24 endlessly moves so as to pass on to the fixing device 25 while being held to a stretching face on the upper part of the conveying belt.

Figure 2:
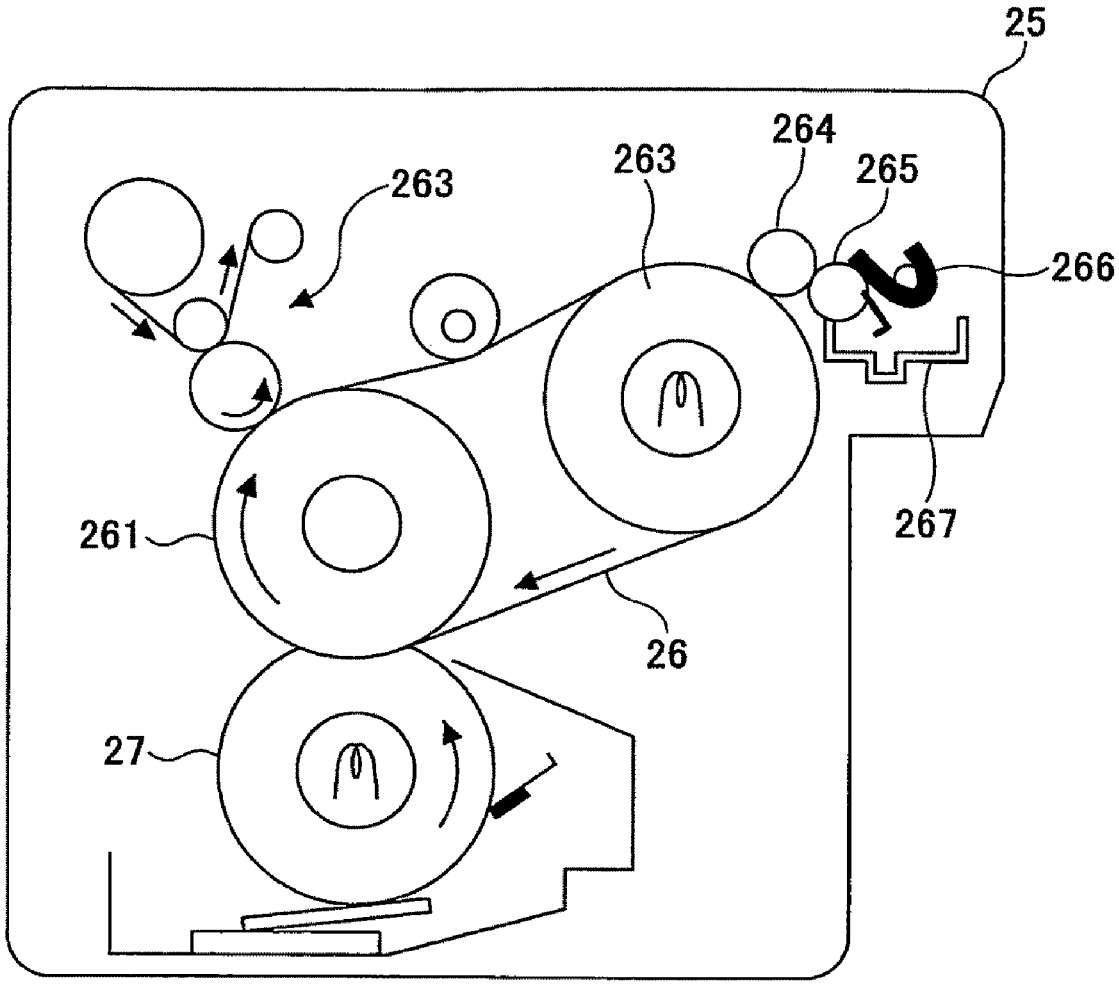
FIG. 2 is an expanded configuration diagram according an exemplary configuration of a fixing device.

FIG. 2 is an expanded configuration diagram illustrating an exemplary configuration of a fixing device 25. The fixing device 25 includes a fixing belt 26, a fixing roller 27, an elasticity drive roller 261, a heating roller 262, a toner removing unit 263, an oil applying roller 264, an oil supplying roller 265, an oil soaked felt 266, an oil receptor plate 267, etc.

The endless-shaped fixing belt 26 endlessly moves in the clockwise direction shown as the elasticity drive roller 261 rotationally drives in the clockwise direction shown while it is being wound to the elasticity drive roller 261, and a heating roller 262 which contains a heating source such as a halogen lamp, etc. Then, it is heated by the heating roller 262 where it is wounded to the heating roller 262. Turning on/off of supplying power to the heating source of the heating roller 262 is controlled by a fixing temperature control section. This fixing temperature control section controls the turning on/off of supplying the power such that the result of sensing by a temperature sensor (not shown) which senses a surface temperature of the fixing belt 26 is brought to a predetermined value.

The fixing roller 27 which contains the heating source such as the halogen lamp abuts with a location at which it is wound to the elasticity drive roller 261 at the fixing belt 26, so that a fixing nip is formed. While forming the fixing nip, the fixing roller 27 is rotationally driven in the counterclockwise direction shown. Turning on/off of supplying power to the heating source of the fixing roller 27 is also controlled by the fixing temperature control section. This fixing temperature control section controls the turning on/off of supplying the power such that the result of sensing by a temperature sensor (not shown) which senses a surface temperature of the fixing roller 27 is brought to a predetermined value.

The transfer paper P which passed through the secondary transfer nip as described above is sent into the fixing device 25 to be placed into the fixing nip. Then, the fixing process of the toner image on the transfer paper P is provided by effects of pressurizing, heating, etc.

A cleaning web of the toner removing unit 263 abuts against the fixing belt 26 which passed through the fixing nip. With the cleaning web, the toner which ended up adhering to the surface of the fixing belt 26 is wiped off. The toner removing unit 263 has a band-shaped web coiled around a coiling roll. Then, the web stretched out from this coiling roller may be reeled up by rotation of a reeling roll. With the fixing belt 26 being abutted against a location between the reeling roll and the coiling roll in the web, an appropriate amount of web is reeled up by the reeling roll according to the progress of the degree of stain of the location to abut the location of the web without the stain against the fixing belt 26.

The oil applying roller 264 abuts against a location at which it is wound to the heating roller 262 at the fixing belt 26. The oil applying roller 264 rotates while being abutted against the surface of the fixing belt 26 to apply oil (silicone oil, for example) as a mold release agent to the same surface.

Near the oil applying roller 264 is provided an oil receptor plate 267; oil soaked felt 266, and an oil supplying roller 265. Oil is retained within the oil receptor plate 267. This oil receptor plate 267 is provided with an overflow tube (not shown) which causes oil within the oil receptor plate 267 to overflow at a certain height location. The oil is periodically replenished to the oil receptor plate 267 by an oil replenishing unit (not shown). Then, excess oil is returned to the oil replenishing unit via the overflow tube.

The oil soaked felt 266 is partially soaked in the oil within the oil receptor plate 267. By a capillary phenomenon, this oil soaked felt 266 makes oil soak into a location at which oil is not soaked.

The oil supplying roller 265 rotates while being abutted against the oil soaked felt 266 and the oil applying roller 264 to apply oil wiped off the oil soaked felt 266 to the oil applying roller 264. In this way, new oil is supplied on a surface of the oil applying roller 264 that lost oil due to applying oil to the fixing belt 26.

The fixing device 25 applies oil to the fixing belt 26 as described above to suppress an offset of the toner with respect to the fixing belt 26. Moreover, the oil applied to the fixing belt 26 is transferred to the fixing roller 27 by a fixing nip into which the transfer sheet P is not placed to also suppress an offset of the toner with respect to the fixing roller 27.

In FIG. 1 as previously shown, the transfer paper on which surface the toner image is transferred at the secondary transfer nip and on which the toner image is fixed at the fixing device 25 is sent out to the surface processing device 70. The transfer paper output from the fixing device 25 is conveyed to the surface processing device 70 via a fixed paper discharging roller pair 56 and a conveying roller pair 57. The transfer paper which is surface processed at the surface processing device 70 is discharged onto a paper discharge tray 59 via the conveying roller pair 58.

Next, a surface processing of transfer paper using the surface processing device 70 of the image forming device 1 is described.

Figure 3:
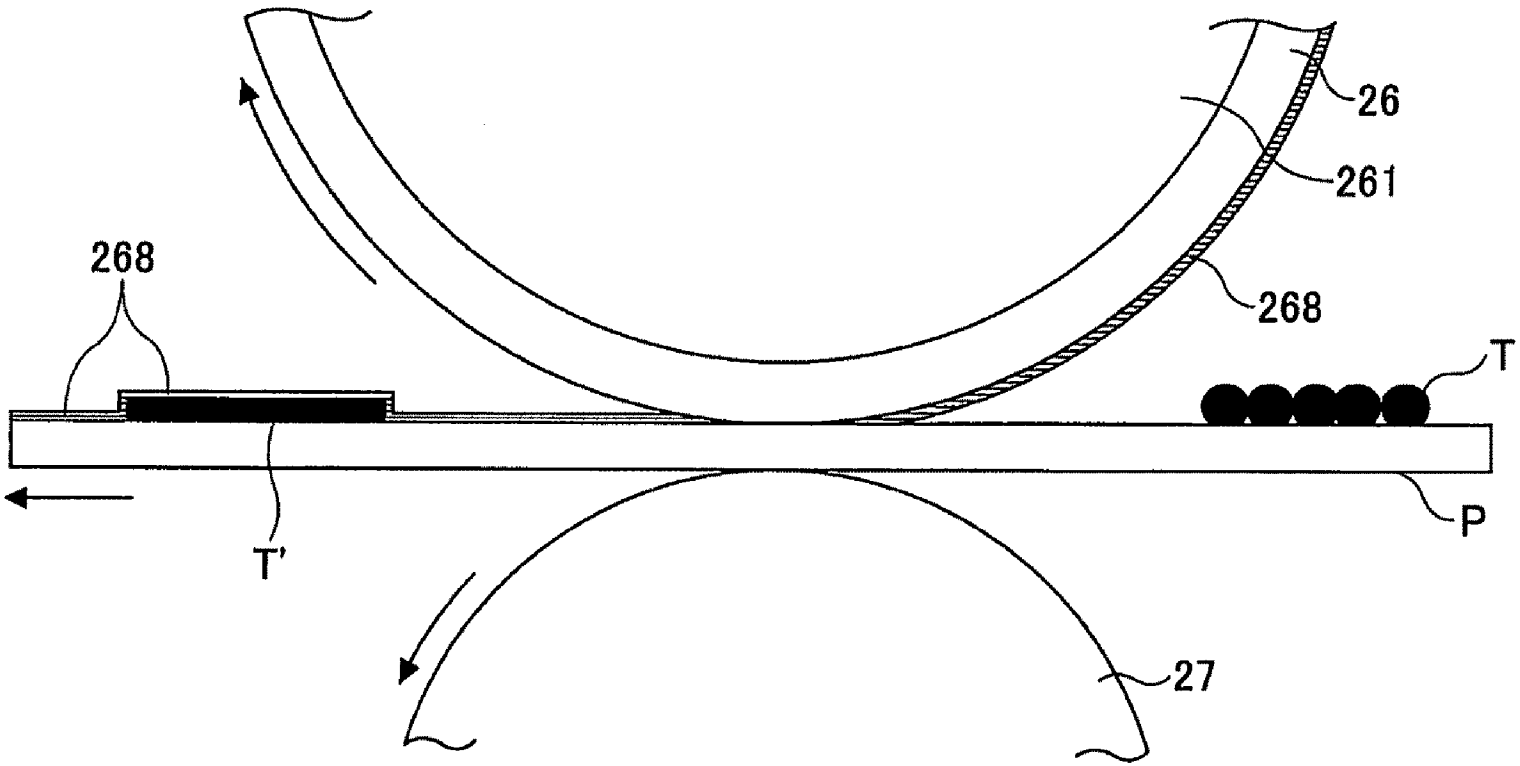
FIG. 3 is a schematic diagram illustrating what a surface of a transfer material looks like before and after a fixing process which fixes a toner image using a fixing member to which oil is applied to the surface.

FIG. 3 is a schematic diagram illustrating how the surface of a transfer material looks like before and after a fixing process which fixes a toner image using a fixing member (a fixing belt 26 or a fixing roller 27) to which surface oil as a mold release agent is applied. As shown in FIG. 3, while a toner T on transfer paper P before the fixing is fixed onto the transfer paper P as powder using electrostatic force, the toner T on the transfer paper P dissolves by a fixing process and is fixed onto the transfer paper P. The oil 268 for obtaining mold releasability with respect to the surface of the toner transfers to a surface of a toner image T' on the transfer paper P or a surface of transfer paper P on which the toner does not exist. Thus, after the fixing process, oil 268 which transferred from the fixing member exists on the whole surface of the transfer paper P including a portion on which the toner image T' is formed. Trying to carry out a coating process which applies varnish for a purpose of providing added value such as a sense of quality or a process of coating a film such as PP, etc., could lead to a phenomenon such that the adhesive of the film or the varnish is repelled, so that the varnish cannot be applied uniformly, or a phenomenon that a certain level of adhesiveness cannot be obtained between the transfer paper P and the film. Moreover, there is also a concern that it is not possible to seal on or add with writing instruments onto the fixed surface of the transfer paper P, on which surface the oil 268 exists, so that it is not possible to obtain a satisfactory level of correctivity.

Figure 4:
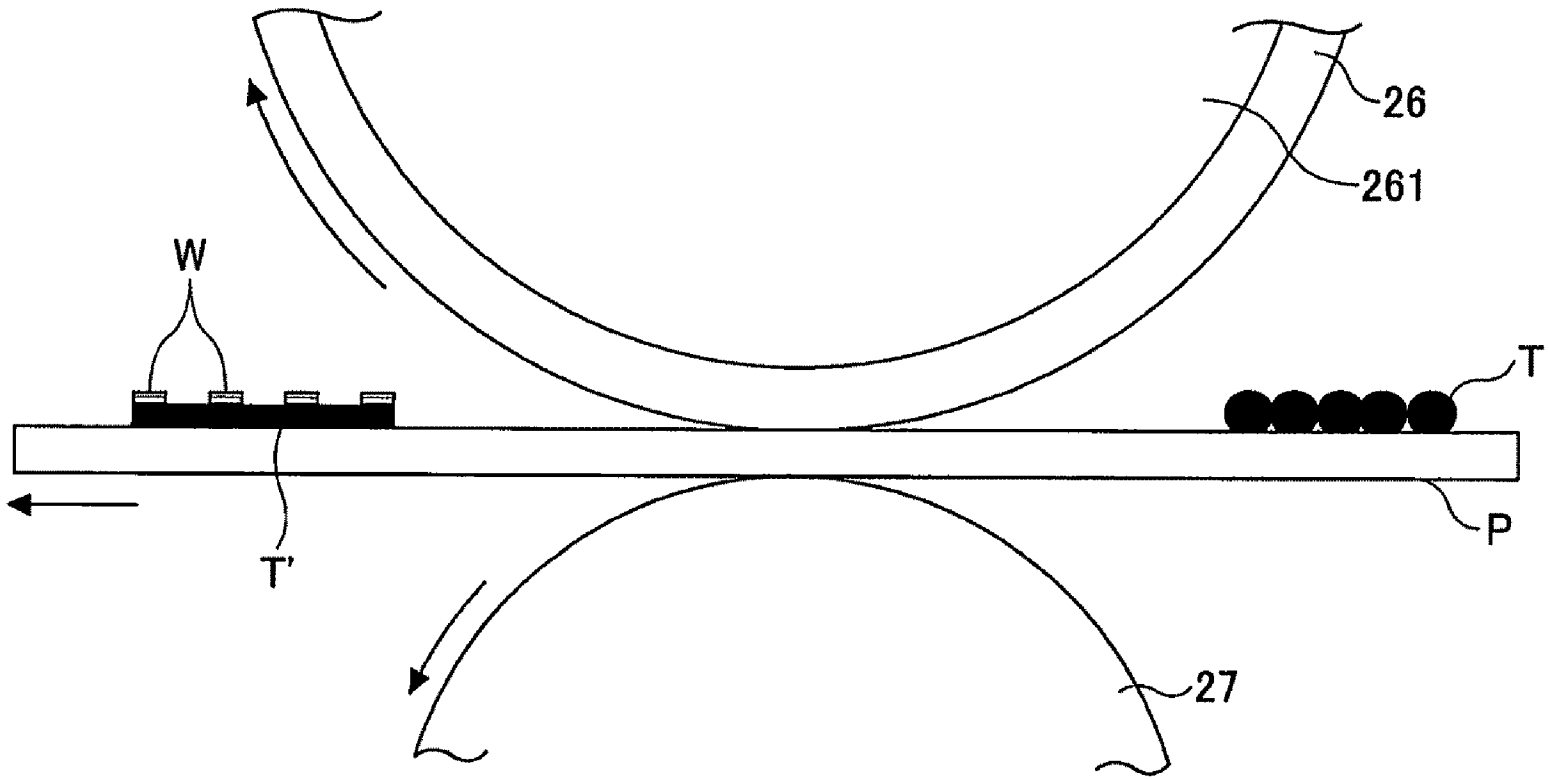
FIG. 4 is a schematic diagram illustrating what the surface of the transfer material looks like before and after the fixing process which fixes the toner image formed on transfer paper using a toner which contains a wax.
Figure 5:
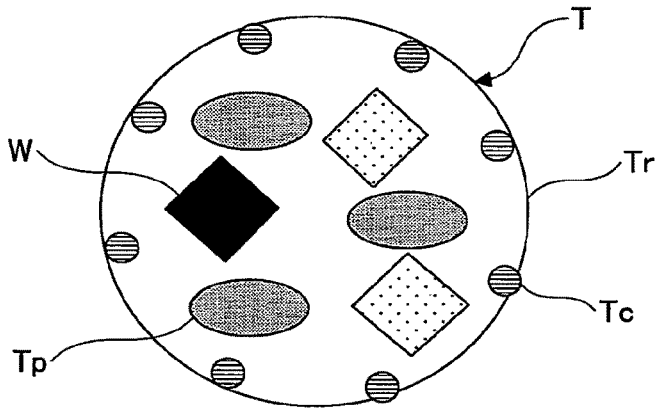
Figure 6:
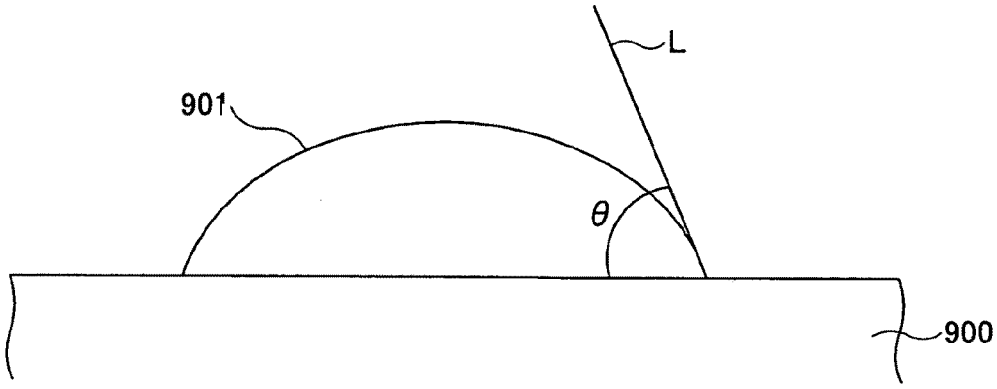
FIG. 6 is an explanatory diagram illustrating an angle of contact.

FIG. 4 is a schematic diagram illustrating what the surface of the transfer material looks like before and after the fixing process which fixes a toner image formed on transfer paper P using a toner which contains a wax as a mold release agent, while FIG. 5 is an explanatory diagram illustrating how an additive such as a wax, etc., that is added to the toner looks like. To the toner T may be added a pigment Tp or a charge control agent Tc with a resin Tr as a major component, and may further be added a wax W, etc., as a mold release agent. Even when fixing the toner image formed on the transfer paper P using the toner T which contains the wax W, in the same manner as for FIG. 3, the toner T on the transfer paper P before the fixing is fixed on the transfer paper P by static electricity as powder, and, by the fixing process, the toner T on the transfer paper P dissolves and fixed onto the transfer paper P. The Wax W which is included in the toner demonstrates an effect of seeping onto the surface of the toner image T' at the time of fixing and obtaining mold releasability with respect to a fixing member (a fixing roller), but remains on the surface of the toner image T' on the transfer paper P after the fixing. There is also a concern that the wax W on the surface of this toner image T' spreads throughout the surface of the transfer paper around the toner image T'. Thus, there is a concern that phenomenon that a satisfactory level of process of coating the varnish and the film cannot be achieved, and a phenomenon that a satisfactory level of correctivity cannot be achieved may occur not only when oil is used for the fixing member of the fixing device 25, but also when the toner image is formed on the transfer paper using the toner which contains wax. Even when using toner which contains wax for the purpose of increasing a degree of room for mold release in fixing, oil may be applied to the fixing member of the fixing device 25.

The oil and the wax, which are designed to obtain an advantage of increasing the mold releasability, are materials having very low wettability, so that they are deemed to easily repel the varnish and the adhesive, etc. As an indicator for expressing this wettability, there is "an angle of contact (a contact angle)" θ, depending on the size of which contact angle the wettability may be expressed. The contact angle θ is an angle formed between a target material 900 and a tangent line L, a line which is tangent to a liquid droplet 901.

The wettability of the surface of the target material may generally be categorized into three types (1)-(3) depending on the size of the contact angle θ: (1) Spreading wetting: when θ=0 degrees, the liquid droplet spreads endlessly in a thin membrane shape; (2) Immersional wetting: when 0 degrees<θ<90 degrees, wetting with solid being immersed in liquid; and (3) Adhesional wetting: 90 degrees<θ<180 degrees, like a state of a morning dew being on a taro leaf. While such a state is being referred to as adhesional wetting, it may be said that it has not been wetted.

When the present inventors dropped a pure water liquid droplet Dw on transfer paper on which a toner image is fixed by the oil applying fixing member or on transfer paper on which a toner image is formed using a wax-containing toner and measured the contact angle θ, the contact angle θ was found to have a value of not below 95 degrees and to fall within the region of (3) "Adhesional wetting" in the above. It is deemed that the fixed transfer paper easily repels the varnish and the adhesive, since it does not undergo wetting, as it is in the region of "Adhesional wetting".

Thus, the image forming device 1 according to the present embodiment is provided with a surface processing device 70 which processes a surface of a transfer paper P that is output from the fixing device 25 in order to improve the wettability of the surface of the fixed transfer paper P. The surface processing device 70 has a discharging unit which generates an electric discharge on or near of the fixed transfer paper P on which the toner image is formed.

Figure 7:
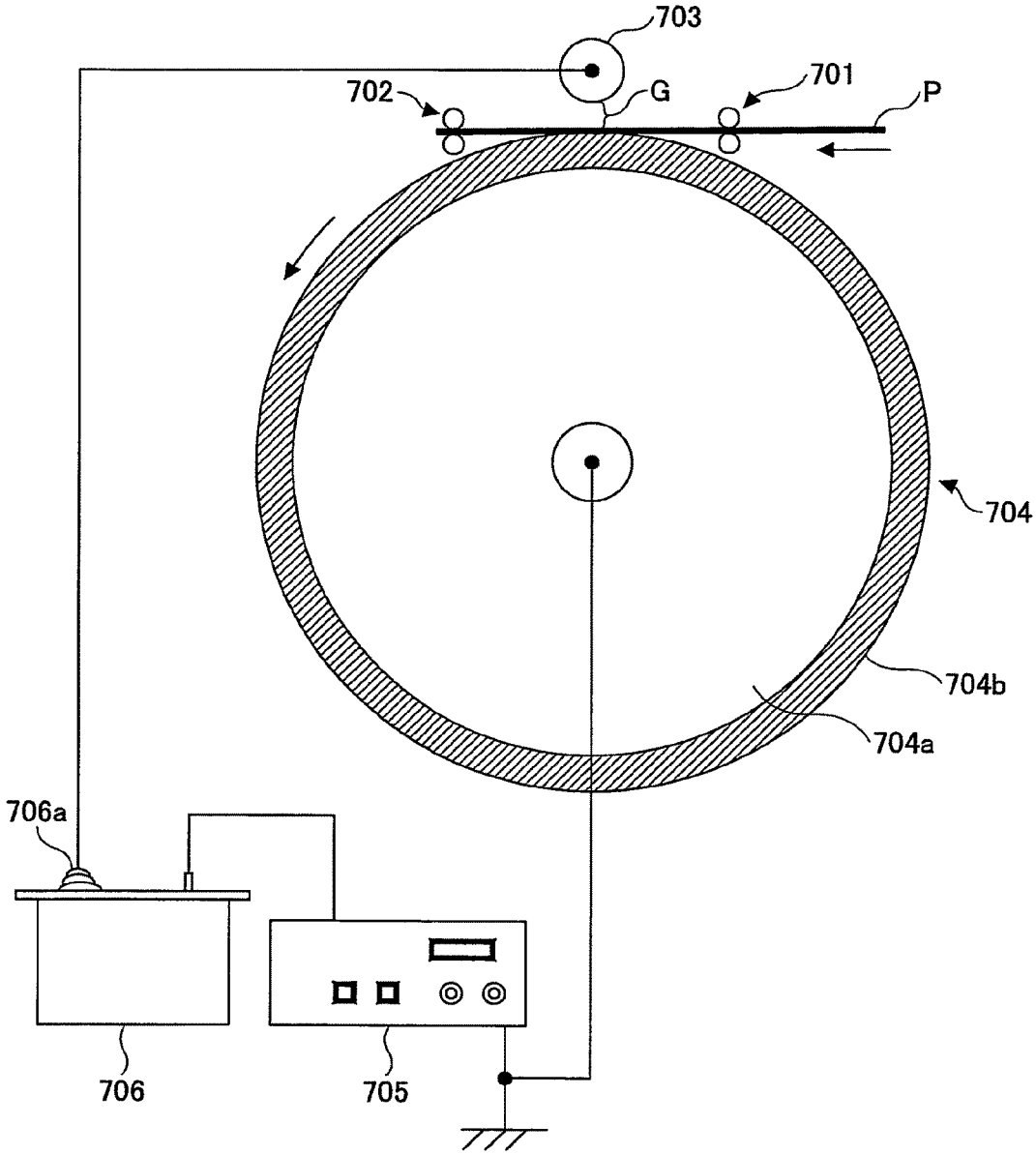
FIG. 7 is a schematic configuration diagram according to an exemplary configuration of a surface processing device.

FIG. 7 is a schematic configuration diagram illustrating an exemplary configuration of the surface processing device 70 of the present embodiment. This surface processing device 70 includes a discharge processing section 700 as the above-described discharging unit and a conveying roller pair 701 and 702 as a conveying unit which conveys the transfer paper such that the transfer paper P fed from the fixing device 25 passes through the discharge generated region. The discharge processing section 700 has a first electrode roller 703 as a first electro-conductive electrode member and a second electrode roller 704 as a second electro-conductive electrode member provided such that it opposes the first electrode roller 703, and a voltage applying unit which applies a predetermined voltage between the first electrode roller 703 and the second electrode roller 704. The first electrode roller 703 opposes, via an air gap G, a surface on which a toner image is formed of a transfer paper P which is conveyed by the conveying roller pair 701 and 702. The second electrode roller 704, which has a dielectric layer **704*b* formed on a surface of a roller-shaped cored bar section 704*a* which includes an electro-conductive member, is provided such that it opposes, via the transfer paper P, the first electrode roller 703. Moreover, the voltage applying unit is arranged using a high-frequency transmitter 705 which generates an alternating voltage of a predetermined frequency f and a high-voltage transformer 706 which raises the magnitude of the alternating voltage output from the high frequency transmitter 705 to a certain voltage. As the high frequency transmitter 705, a high-frequency power supply (CT-0212) made by Kasuga Electric Works, Ltd. may be used, while, as the high voltage transformer 706, a transformer (CT-T02W) made by Kasuga Electric Works, Ltd. may be used, for example. Moreover, in the example in FIG. 7, the cored bar section 704*a* of the second electrode roller 704 and a ground terminal of the high frequency transmitter 705 are grounded, while an output terminal 706*a* from which is output an alternating voltage including a certain voltage value and frequency of the high-voltage transformer 706 is connected to the first electrode roller 703. When the first electrode roller 703 is applied a predetermined alternating voltage, a dielectric barrier discharge is generated in an air gap G between a surface of transfer paper P conveyed in contact with the second electrode roller 704 and the first electrode roller 703**.

In the above-configured surface processing device 70, the frequency f of the alternating voltage to be output from the high frequency transmitter 705 is preferably in the range between 20 kHz and 500 kHz. The frequency region below 20 kHz down to 20 Hz overlaps a human audible range and sound produced at the time of the electric discharge is unpleasant and harsh, so that it is not preferable. Moreover, in the frequency region below 20 Hz down to direct current, discharging which is uniform relative to an axial direction of the first electrode roller 703 and the second electrode roller 704 does not occur (i.e., discharging is concentrated locally), so that it is not preferable. On the other hand, in a frequency region above 500 kHz, a low-resistant discharge channel is likely to be formed by a residual ion which is an ion produced by discharging in the air gap G remaining as it is therein, so that, not only the electric discharge becomes concentrated locally, so uniform processing may not be performed, but also it is not preferable from a security point of view as a large current flows and a high heat is produced. In this case, as for a waveform of the alternating voltage which is output from the high frequency transmitter 705, there is no particular limit as long as it is within the range of 20 kHz to 500 kHz, so that it may be a sine wave or a square wave (including a pulse-shaped waveform).

The output voltage value (peak-to-peak voltage) of the high voltage transformer 706 applied to the first electrode roller 703 may be appropriately determined according to the dielectric characteristic and the thickness of the dielectric layer 704*b* of the second electrode roller 704 and the transfer paper P, and the magnitude of the gap between the first electrode roller 703 and the second electrode roller 704, but it is preferably in the range between 5 $kV_{p-p}$ and 30 $kV_{p-p}$ for the gap of 1 mm. When the output voltage value of the high voltage transformer 706 is lower than 5 $kV_{p-p}$, there may be a case such that it does not reach a dielectric breakdown voltage of the air which exists in the gap and a discharging does not occur, so that it is not preferable. Moreover, when the output voltage value of the high voltage transformer 706 is higher than 30 $kV_{p-p}$, it becomes likely that arc discharging takes place between the first electrode roller 703 and a surrounding member, so that it is not preferable from a security point of view. The gap between the first electrode roller 703 and the second electrode roller 704 is in a substantially proportional relationship with a preferable range of the output voltage value of the high voltage transformer 706, so that, for the gap other than 1 mm, the output voltage value of the high voltage transformer 706 for the gap may be determined based on 5-30 $kV_{p-p}$, which is a preferable range for 1 mm.

Moreover, it suffices that the magnitude of the gap g between the first electrode roller 703 and the second electrode roller 704 (see FIG. 8) is no less than the thickness of the transfer paper P to be processed, and is generally not more than 3 mm. When it is more than 3 mm, it is not preferable because a high voltage is needed for discharging.

Moreover, a material of the first electrode roller 703 may be appropriately selected from metals including iron, copper, aluminum, stainless steel, etc., the stainless steel is preferable which is hard to be fretted by ozone occurring at the time of an electric discharge. Also for a heart of the second electrode roller 704, it is similar to the material of the first electrode roller 703.

Figure 8:
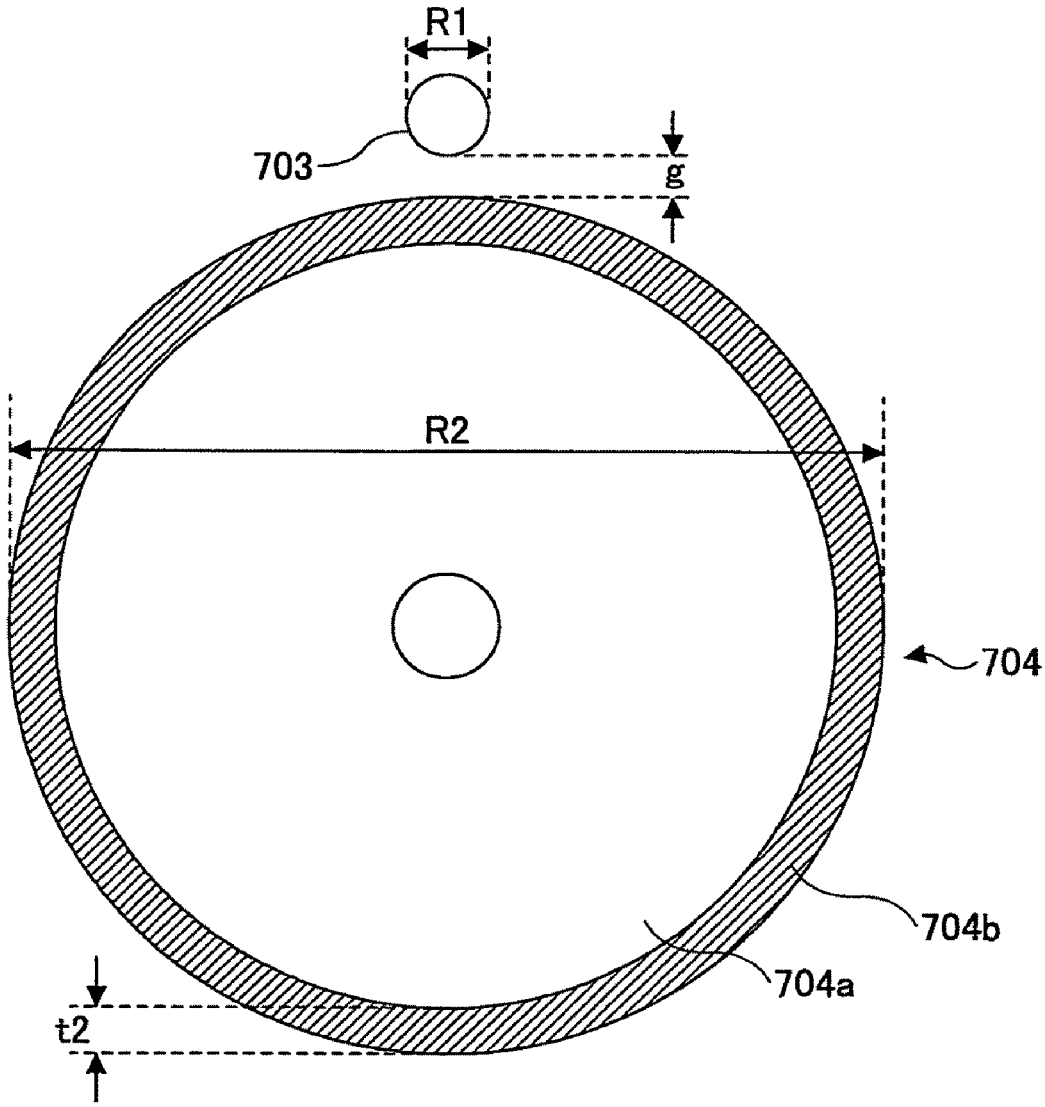
FIG. 8 is a diagram for explaining dimensions and a positional relationship between a first electrode roller and a second electrode roller.

Moreover, the diameter R2 of the second electrode roller 704 is preferably larger than the diameter R1 of the first electrode roller 703 (see FIG. 8). In other words, it is more preferable that the second electrode roller 704 is an assumed plane when viewed from the first electrode roller 703 side. In this way, an appearance of the second electrode roller 704 being the assumed plane from the first electrode roller 703 makes it possible to provide the surface of the transfer paper P with a wider and more uniform discharge region (also may be called a region of a surface discharge occurring in a transfer paper moving direction), making it possible to obtain the effect of uniform and wasteless processing. On the other hand, when the diameter of the second electrode roller 704 is smaller than the diameter of the first electrode roller 703, the discharge region is concentrated in a region where the distance between the electrode roller 703 and the second electrode roller 704 is shortest, so that the distance of a surface discharge becomes short, so that the process is carried out in a very narrow (line-shaped) region. Thus, even a quite small change in the conveying speed of the transfer paper P may become causes for process unevenness within a face of the transfer paper P, and for facilitating degradation of dielectric body layer due to concentrated discharge power.

A material of the dielectric layer 704*b* of the second electrode roller 704 may be appropriately selected from ceramics such as titania, zirconia, alumina, quartz, and glass; rubber such as silicon rubber; or plastic such as polyimide, polytetrafluoroethylene, polyethylene, polyester, and acrylic; but is preferably glass, quartz, alumina, etc.; that is difficult to be fretted by discharging, wherein the relative permittivity is between 2 and 10. When the relative permittivity is less than 2, it is not preferable because a high voltage is needed for discharging. Moreover, when the relative permittivity is more than 10, it is not preferable because the discharge is likely to be concentrated locally.

The thickness t2 of the dielectric layer 704*b* (see FIG. 8) is preferably between 0.1 mm and 5 mm. When it is less than 0.1 mm, it is not preferable from a safety point of view as arc discharging occurs due to breakdown. For glass, quartz, alumina, etc., it is more preferably not less than 1 mm, further taking into account the mechanical strength. When it is more than 5 mm, it is not preferable because a high voltage is needed for discharging.

Moreover, in order to reduce fretting of the dielectric layer 704*b* due to discharging, it is preferable that the second electrode roller 704 rotates in a manner such that it is covered in a dielectric around the periphery. The second electrode roller 704 can rotationally drive by means of a drive unit such as a motor (not shown).

Figure 9:
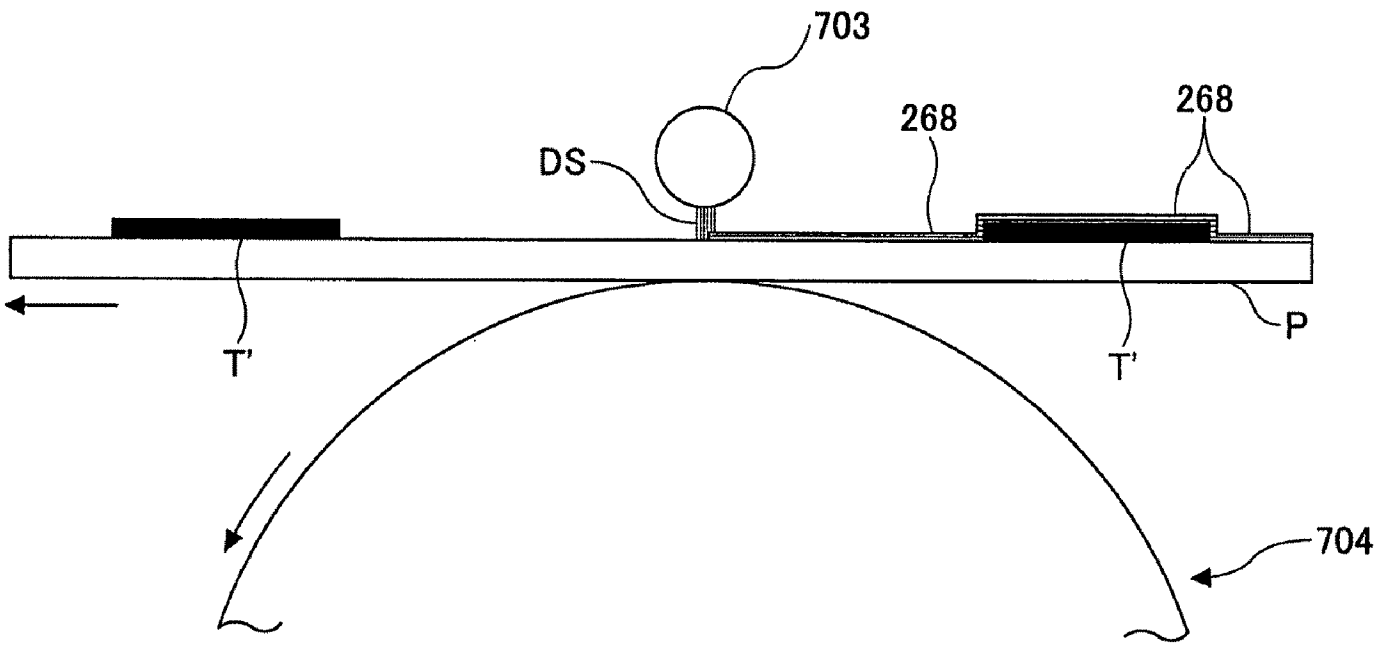
FIG. 9 is a schematic diagram illustrating what a surface of a fixed transfer paper looks like before and after a discharging process, on which surface is fixed a toner image using a fixing member to which oil is applied to the surface.

FIG. 9 is a schematic diagram illustrating how a surface looks like before and after a discharging process, which surface is of a fixed transfer paper on which a toner image is fixed using a fixing member to which oil is applied to the surface. As shown, when surface processing is carried out which generates a discharge DS on the surface of the fixed transfer paper P, on which surface the oil 268 exists, the oil 268 which exists on the surface reduces for either one of a portion of the toner image on the surface of the transfer paper P and a portion on which the toner image is not formed. In this way, while the mechanism in which the oil 268 reduces is not clearly elucidated, it is deemed that an effect that the discharge DS facilitates the phenomenon that the oil 268 which exists on the surface of the transfer paper P soaks into the toner image and into the transfer paper P and discharging effects such as "oxidation", "bridging", "resolution", etc., are involved. Moreover, it is deemed that the electric discharge DS also has an effect that a hydrophilic functional group is produced on the fixed surface of the transfer paper P. The generating of the hydrophilic functional group, the decrease in the oil, etc., improves the wettability on the fixed surface of the transfer paper P. When the pure water contact angle θ is actually measured for the surface of the transfer paper P after the discharging process, there is seen a decrease from not less than 95 degrees to not more than 90 degrees. In this way, an improvement in the wettability on the fixed surface of the transfer paper P makes it possible to carry out a satisfactory level of a process of coating the varnish, film, etc., on the fixed surface of the transfer paper P, making it possible to improve the correctivity on the fixed surface of the transfer paper P.

Figure 10:
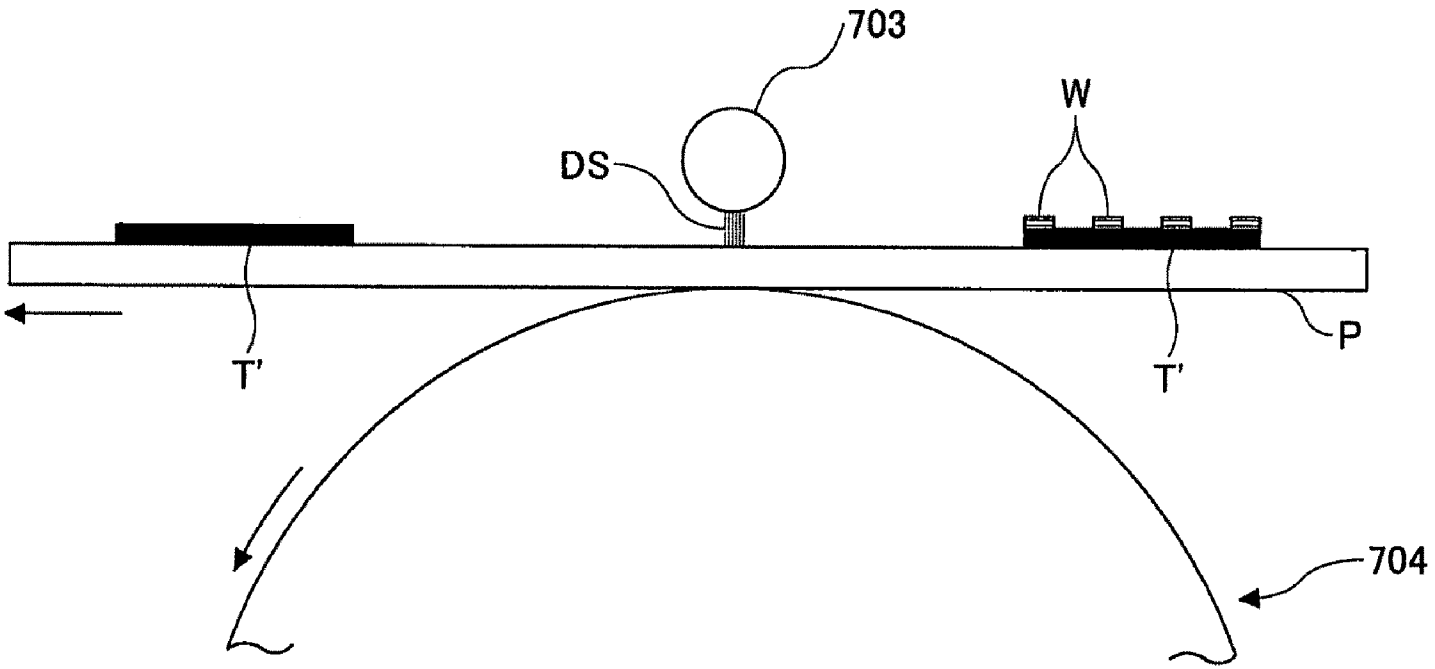
FIG. 10 is a schematic diagram illustrating what the surface of the transfer material looks like before and after the fixing process which fixes the toner image formed on transfer paper using the toner which contains the wax.

FIG. 10 is a schematic diagram illustrating how the surface of the transfer material looks like before and after the discharging process, on which surface is fixed a toner image formed on transfer paper using a toner which contains a wax. As shown, when a surface processing is carried out which generates a discharge DS on the fixed surface of the transfer paper P, on which surface is formed a toner image T' using a wax-containing toner, wax W which exists on the surface of the toner image T' on the transfer paper P decreases. In this way, while the mechanism in which the wax decreases is also not clearly elucidated, it is deemed that an effect that the discharge DS facilitates the phenomenon that the wax W which existed on the surface of the transfer paper P soaks into the toner image and discharging effects such as "oxidation", "bridging", "resolution", etc., are involved. Moreover, it is deemed that the electric discharge DS also has an effect that a hydrophilic functional group is produced on the fixed surface of the transfer paper P. The generating of the hydrophilic functional group, the decrease in the wax, etc., improves the wettability on the fixed surface of the transfer paper. Then, when the pure water contact angle θ is actually measured for the surface of the transfer paper P after the discharging process, there is seen a decrease from not less than 95 degrees before the surface processing to not more than 90 degrees. In this way, an improvement in the wettability on the fixed surface of the transfer paper P makes it possible to carry out a satisfactory level of a process of coating the varnish, film, etc., on the fixed surface of the transfer paper P, making it possible to improve the correctivity on the fixed surface of the transfer paper P.

Next, an embodiment is described in which a more quantitative result is obtained therefrom for improving the wettability of the fixed transfer paper P by the discharging process. In this embodiment, using two types of transfer paper, transfer paper X (POD gloss coated paper manufactured by Oji Paper Corporation) and transfer paper Y (POD mat coated paper manufactured by Oji Paper Corporation), after a toner image is formed using two types of wax-added toners A and B, a fixing member on which the oil is applied to the surface is used to carry out the fixing process.

Figure 11A:
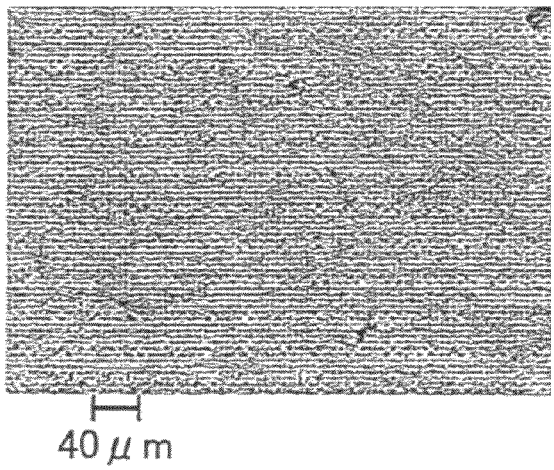
FIGS. 11A and 11B are, respectively, SEM photographs of the surface of the transfer paper used in an embodiment.
Figure 11B:
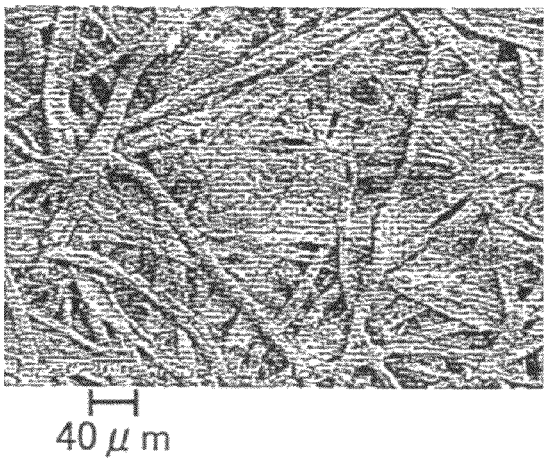

FIGS. 11A and 11B are respectively photographs taken (with a magnifying power of 250) by a scanning electron microscope (SEM) of the surface of the transfer paper X and transfer paper Y before forming the toner image. From these photographs of the SEM images, it can be seen that the smoothness of the surface of the transfer paper X is higher than that of the surface of the transfer paper Y.

The toner A and the toner B are respectively manufactured as follows:

(Manufacturing of Toner A)

Prescription of a coloring agent, two types of mold release agents, and two types of binder resins are premixed using a Henschel mixer (FM10B manufactured by Mitsui Miike Kakouki Co., Ltd.), and then fused and kneaded with two axis kneaders (PCM-30 manufactured by Ikegai Corporation) at a temperature of 100-130 degrees Celsius. The kneaded material obtained is cooled to room temperature, and then coarsely crushed to 200-300 μm in a hammer mill. Then, a supersonic jet crusher Labojet (manufactured by Nihon Pneumatic Mfg. Co., Ltd.) is used to perform fine crushing while appropriately adjusting the crush air pressure such that a weight average particle diameter becomes 6.0±0.3 μm, and then an air classifier (MDS-1; manufactured by Nihon Pneumatic Mfg. Co., Ltd.) is used to perform classifying while appropriately adjusting the louver opening such that the amount of fine particle which is not more than 6.8±0.3 μm, 0.4 μm becomes not less than 10 number % and to obtain a toner base particle. Then, for 100 parts per weight of the toner base particle, two types of additives as described below are stirred and mixed using a Henschel mixer.

Binder Resin:

Binder resin A . . . polymer of addition of bisphenol A ethylene oxide, addition of bisphenol A propylene oxide, terephthalic acid; softening point: 110 degrees Celsius; glass transition temperature: 60 degrees Celsius; acid value: 5; Mn, 2800; Mw: 8000; 50 parts by weight;

Binder resin B . . . polymer of addition of bisphenol A ethylene oxide, addition of bisphenol A propylene oxide, trimerit acid, fumaric acid, terephthalic acid; softening point: 200 degrees Celsius; glass transition temperature: 66 degrees Celsius; acid value: 12, Mn: 2800, Mw: 45000, 50 parts by weight;

Mold Release Agent:

Mold release agent A . . . Carnauba wax; melting point 78 degrees Celsius; 3 parts by weight;

Mold release agent B . . . ethylenebis stearic acid amide; melting point 145 degrees Celsius; 2 parts by weight;

Coloring agent: carbon black; 10 parts by weight;

Additive: Inorganic fine particle A . . . $SiO_2$ (hydrophobic process of the surface with silane coupling agent); average particle diameter 0.01 μm; added amount 1.0 parts by weight Inorganic fine particle B . . . $TiO_2$ (hydrophobic process of the surface with silane coupling agent); average particle diameter 0.02 μm; added amount 1.0 parts by weight (Manufacturing of Toner B)

Prescription of two types of binder resin, a mold release agent, a coloring agent, and two types of additives are used to manufacture B in the same manner as the manufacturing of the toner A.

Binder resin: binder resin A . . . polymer of addition of bisphenol A ethylene oxide, addition of bisphenol A propylene oxide, terephthalic acid; softening point: 100 degrees Celsius; glass transition temperature: 65 degrees Celsius; acid value: 5 mgKOH/g; Mn: 2800; Mw: 13000; 50 parts by weight;

Binder resin B . . . polymer of addition of bisphenol A ethylene oxide, addition of bisphenol A propylene oxide, trimetric acid, fumaric acid, terephthalic acid; softening point: 140 degrees Celsius; glass transition temperature: 65 degrees Celsius; acid value: 16; Mn: 2400; Mw: 45000; 50 parts by weight;

Mold release agent: Carnauba wax; melting point 78 degrees Celsius; 5 parts by weight;

Coloring agent: carbon black 10 parts by weight;

Additive: inorganic fine particle A . . . $SiO_2$ (hydrophobic process of the surface with silane coupling agent); average particle diameter 0.01 μm; added amount 1.0 parts by weight: inorganic fine particle B . . . $TiO_2$ (hydrophobic process of the surface with silane coupling agent); average particle diameter: 0.02 μm; added amount 1.0 parts by weight Here, properties of polyester resin in manufacturing the toners A and B in the above are measured as follows:

Using a flow tester (CFT-500D, manufactured by Shimadzu Corporation), while a sample of 1 g is heated at a rising temperature speed of 6 degrees Celsius per minute, a load of 1.96 MPa is applied thereto with a plunger, pushing it out from a nozzle with a diameter of 1 mm and a length of 1 mm. Amount of plunger descent of the flow tester is plotted against temperature, setting, as a softening point, a temperature at which a half of the amount of samples flows out.

Glass Transition Point of Resin

Using a differential scanning calorimeter (DSC210; manufactured by Seiko Denshi Kogyo K. K.), a sample of 0.01-0.02 g is dispensed into an aluminum pan, raised to a temperature of 200 degrees Celsius; The temperature of the sample cooled to 0 degrees Celsius at a falling temperature speed of 10 degrees C./minute is raised at a rising temperature speed of 10 degrees C./minute to set to a temperature of an intersection point between an extension line of a baseline of not more than a maximum peak temperature of heat absorption and a tangent line which represents a maximum slope from a rising part of a peak to an apex of a peak.

Acid Value of Resin

This is measured based on JIS K0070 method. Only the solvent to be measured is changed from a mixture solvent of ethanol and ether as specified in JIS K0070 to a mixture solvent of acetone and toluene (acetone:toluene=1:1 (volume ratio)).

Content of low molecular weight component of not more than molecular weight of resin of 500

Molecular weight distribution is measured by gel permeation chromatography (GPC). 10 ml of tetrahydrofuran and 30 mg of toner are added and mixed in a ball mill for one hour, and then filtered using a fluoric resin filter "FP-200" (manufactured by Sumitomo Electric Industries, Ltd.) of pore size 2 μm to remove insoluble components and prepare a sample solution.

Tetrahydrofuran as an eluate is flushed at a flow rate of 1 ml per minute, a column is stabilized in a thermostatic chamber of 40 degrees Celsius, and a sample solution 100 μl is poured to carry out the measurement. "GMHLX+G3000HXL" (manufactured by Tosoh Corporation) is used for an analytical column, a calibration curve of molecular weight is drawn with a number of types of monodispersion polystyrene (2.63×103, 2.06×104, 1.02×105; manufactured by Tosoh Corporation; and 2.10×103, 7.00×103, and 5.04×104; manufactured by GL Sciences, Inc.) as a standard sample. Content (%) of an component of a low molecular weight of not more than 500 is calculated as a ratio of an area of a region in question in a chart area obtained with a RI (Refractive Index) detector relative to the area of the whole chart (area of the region in question/area of the whole chart).

Figure 12:
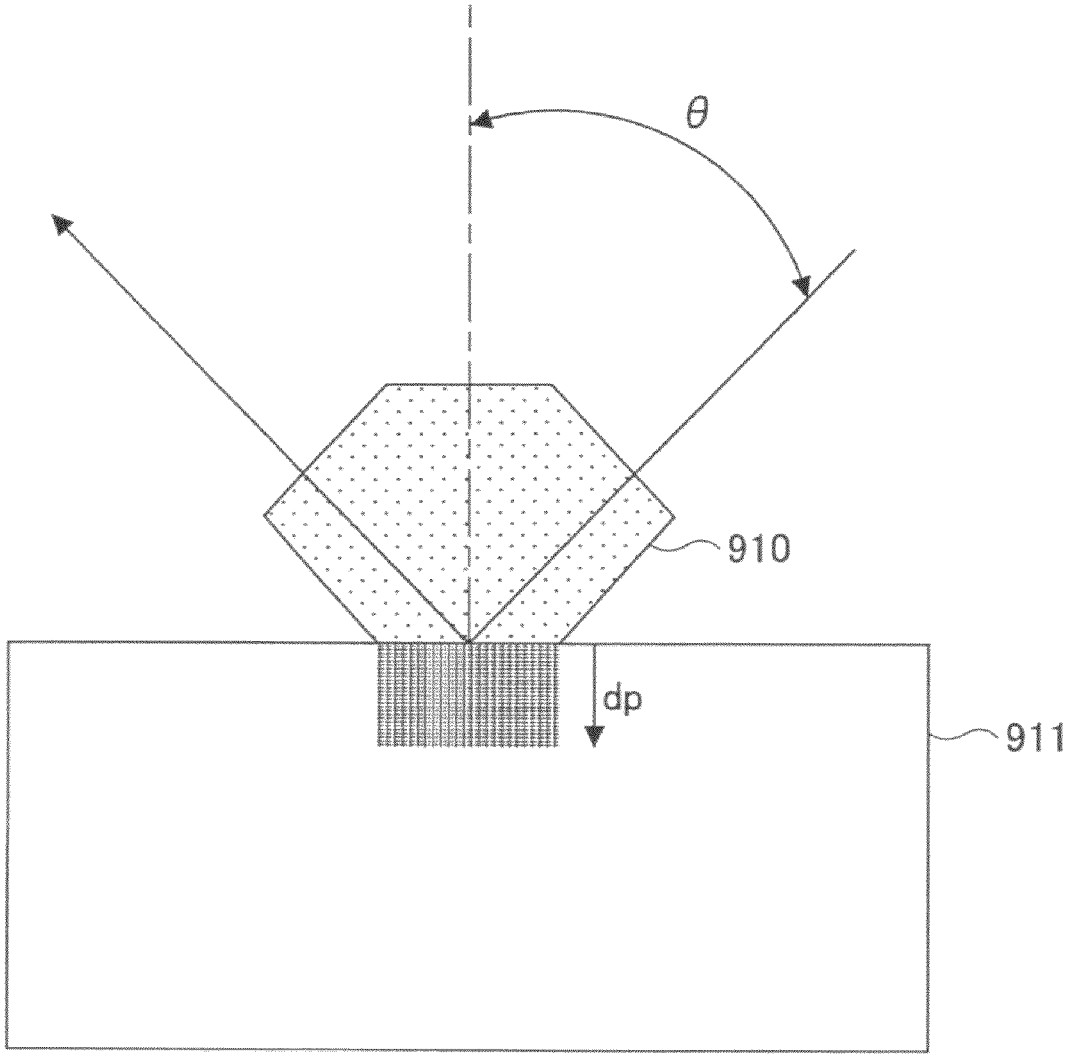
FIG. 12 is a diagram which explains a principle of an FTIR-ATR method.

For analyzing oil and wax of the surface of the transfer paper P, FTIR (Fourier transform infrared spectroscopy)-ATR (attenuated total reflection) method is used. As shown in FIG. 12, this FTIR-ATR method is a technique such that infrared light is totally reflected at an interface of an ATR crystal 910 and a sample 911 (transfer paper in the present embodiment) and a small amount of light is detected which penetrates from the reflection face to the sample 911 side. The ATR profiling depth (penetration depth) dp is defined as a depth such that the strength of light which is incident on the interface becomes 1/e, and, when there is no absorption in the sample 911, it is expressed in the following equation:

$$d_p = \frac{\lambda_1}{2\pi(\sin^2\theta - n_{21}^2)^{1/2}} \qquad \text{Equation 1}$$

Here, θ is an incidence angle (41.5 degrees), $n_{21}$ is $n_2/n_1$ ($n_1$: refractive index of the ATR crystal 910, $n_2$: refractive index of the sample 911) and $\lambda_1$ is $\lambda/n_1$ (wavelength of light within the ATR crystal). When the ATR crystal 910 is a Ge crystal, the above value $n_1$ is 4.0.

Figure 13:
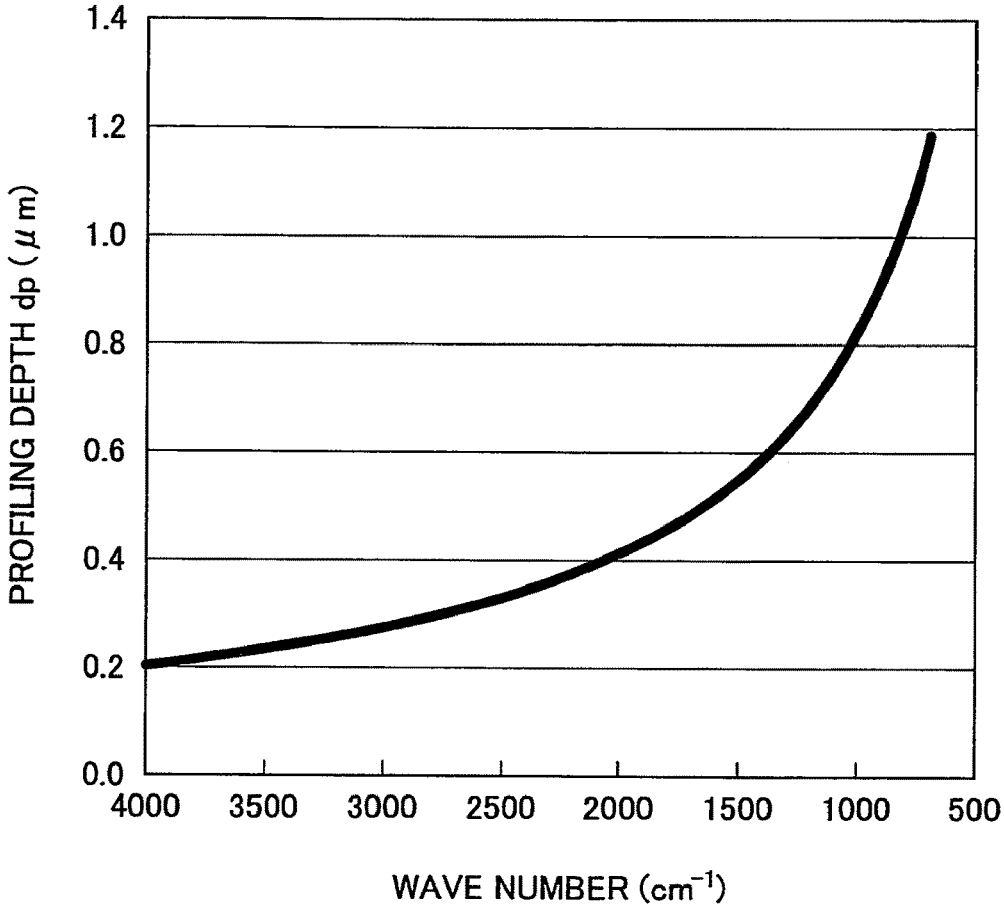
FIG. 13 is a graph which shows a wave number dependency of an ATR profiling depth (penetration depth)

FIG. 13 is a graph showing wave number dependency of an ATR profiling depth (penetration depth) dp when the Ge crystal is used as the ATR crystal 910 and the incidence angle θ is 41.5 degrees. The refractive index n2 of the sample 911 is assumed to be 1.5, which is a common value for an organic substance. As shown, the profiling depth dp becomes smaller for a higher wave number, so that it becomes in the order of 0.8 μm for the wave number of 1000 $cm^{-1}$ and 0.3 μm for the wave number of 3000 $cm^{-1}$.

Here, the absorption wave number specific to wax, for example, is 2890 $cm^{-1}$, so that, with reference to FIG. 13, the depth measured by the FTIR-ATR method is approximately 0.3 μm. Thus, the FTIR-ATR method makes it possible to sense infrared absorption by wax or oil which only exists on the surface of the toner image and measure the amount thereof.

Tables 1 and 2 indicate results of measuring oil and wax amounts on the toner image before and after a discharging process on fixed transfer paper X (POD gloss coated paper) on which the toner image (s solid image) is formed using the toners A and B. The values of Tables 1 and 2 are such that measured values of oil and wax before the discharging process are set as 1.0, so that measured values of the oil and the wax after the discharging process are determined with the value set in the above as a standard. Moreover, Both Tables 1 and 2 also show results of measuring wax and oil on the toner image of the transfer paper X when it is left for a certain time without carrying out the discharging process after the fixing. The value for a case that it is left without the discharging process is also a value determined such that the measured value before the discharging process is set to 1.0.

TABLE 1

| TONER A (TRANSFER PAPER X) | | |
|---|---|---|
| | OIL | WAX |
| BEFORE DISCHARGING PROCESS | 1.0 | 1.0 |
| AFTER DISCHARGING PROCESS | 0.3 | 0.7 |
| LEAVE AS IT IS WITHOUT DISCHARGING PROCESS | 0.9 | 1.0 |

TABLE 2

| TONER B (TRANSFER PAPER X) | | |
|---|---|---|
| | OIL | WAX |
| BEFORE DISCHARGING PROCESS | 1.0 | 1.0 |
| AFTER DISCHARGING PROCESS | 0.2 | 0.3 |
| LEAVE AS IT IS WITHOUT DISCHARGING PROCESS | 0.2 | 1.0 |

As shown in Tables 1 and 2, for both the toners A and B, the wax and the oil on the toner image of the transfer paper have decreased due to the discharging process. For the toner B, oil has decreased even for a case such that it is left without performing the discharging process after the fixing.

Conceivably, this is due to the fact that, after the toner image including the toner B on the transfer paper X is fixed, while it is left without performing the discharging process, the oil which existed on the surface gradually soaked into the toner picture.

Figure 14A:
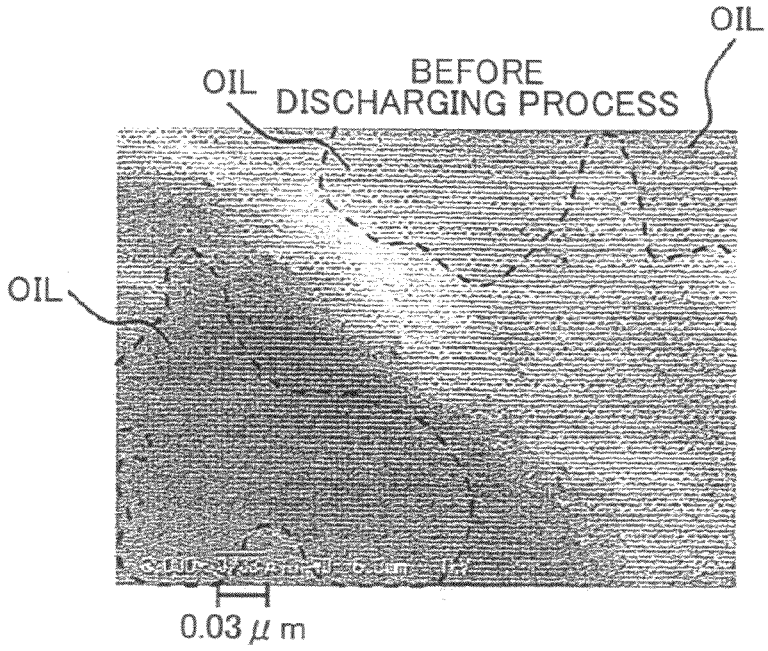
FIGS. 14A and 14B are, respectively, SEM photographs of the fixed surface of the transfer paper before and after the discharging process.
Figure 14B:
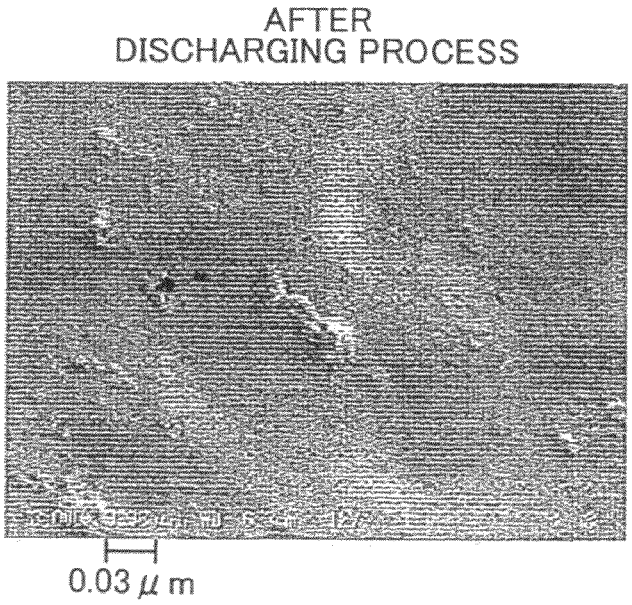

FIGS. 14A and 14B are, respectively, SEM photographs (at a magnifying power of 3000) of the fixed surface of the transfer paper before and after a discharging process. As shown in FIG. 14A, oil used in the fixing remains on the fixed surface of transfer paper before the discharging process. When the discharging process is performed on the transfer paper, oil is almost not observed as shown in FIG. 14B.

Table 3 shows the result of measuring the contact angle θ on the transfer paper before and after the discharging process for both the transfer paper X (POD gloss coated paper) and transfer paper Y (POD mat coated paper) that are fixed. The contact angle θ is measured by dropping a pure water liquid droplet on the surface of each of the transfer paper X and Y which are fixed. As shown in Table 3, for the transfer paper before the discharging process, the contact angle θ is large, being not less than 80 degrees, so that the wettability is not good, but through the discharging process, the contact angle θ of the surface of each of the transfer paper X and the transfer paper Y becomes not more than 50 degrees, so that the wettability has improved.

TABLE 3

| | TRANSFER PAPER X | TRANSFER PAPER Y |
|---|---|---|
| BEFORE DISCHARGING PROCESS | 83° | 101° |
| AFTER DISCHARGING PROCESS | 45° | 36° |

Table 4 indicates results of measuring the contact angle θ on the toner image before and after a discharging process on two types of fixed transfer paper X (POD gloss coated paper) on which the toner image (s solid image) is formed using the toners A and B. The contact angle θ is measured by dropping a pure water liquid droplet on the toner image of the transfer paper which is fixed. As shown in Table 4, for both toners A and B, the wettability is not good for the toner image of the transfer paper before the discharging process as the contact angle θ takes a large value of not less than 100 degrees (which is a value larger than 90 degrees), but the wettability increases through the discharging process as the respective contact angles θ take a value of not more than 70 degrees, which is significantly below 90 degrees.

TABLE 4

| | TONER A | TONER B |
|---|---|---|
| BEFORE DISCHARGING PROCESS | 103° | 107° |
| AFTER DISCHARGING PROCESS | 66° | 63° |

Figure 15:
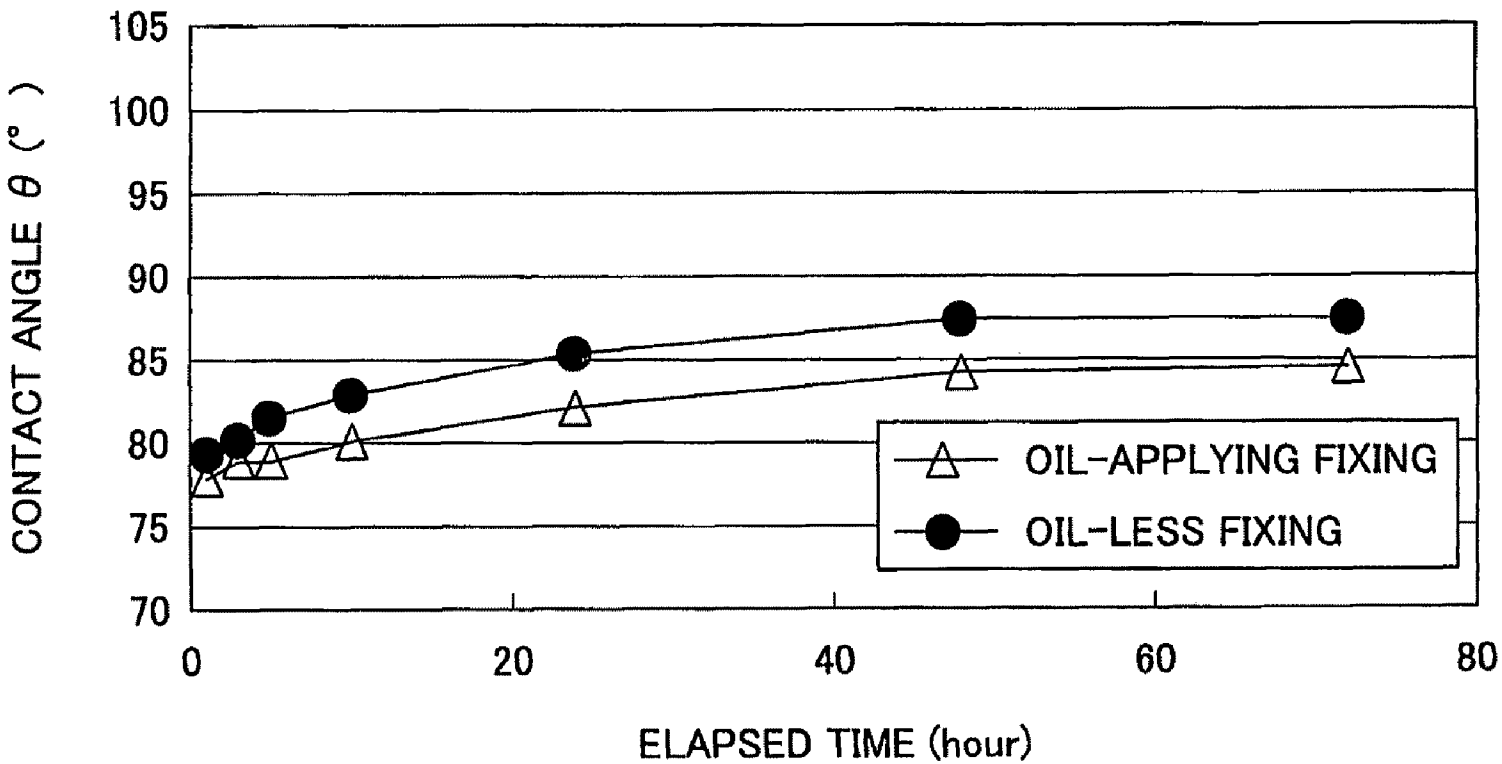
FIG. 15 is a graph which shows a temporal transition of the angle of contact on a toner image after the discharging process that is measured for a transfer paper after a fixing process that is fixed by two types of fixing processes.

FIG. 15 is a graph indicating the temporal transition of the contact angle θ on the toner image (solid image) after the discharging process that is measured for the transfer X (POD gloss coated paper) after the process of fixing for two types of fixing process (oil applying fixing and oil-less fixing). The toner image on the individual transfer paper is formed using a toner which contains wax. Moreover, the contact angle θ is measured by dropping a pure water liquid droplet on the fixed surface of the transfer paper. The contact angle θ before performing the discharging process is 103 degrees for the oil applying fixing and 104 degrees for the oil-less fixing, which, in either case, is a value not less than 100 degrees (a value which is larger than 90 degrees), so that the wettability is not good. As shown in FIG. 15, after the discharging process is performed, for both the oil-applying fixing and the oil-less fixing, the contact angle θ becomes larger over time, but can be held to not exceed 90 degrees even after 70 hours.

Figure 16:
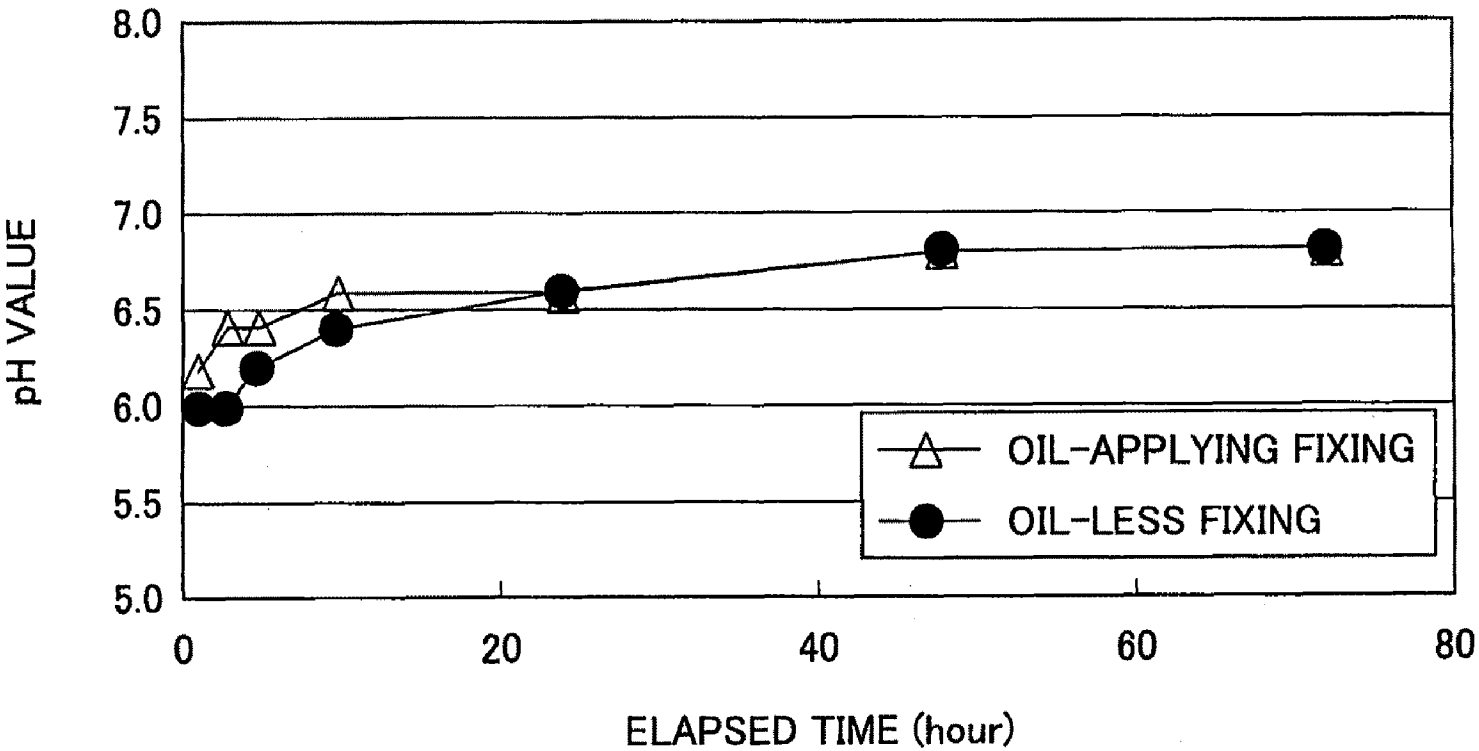
FIG. 16 is a graph which shows a temporal transition of a pH value of a surface that is measured for the transfer paper after the fixing process that is fixed by each of two types of fixing processes.

FIG. 16 is a graph indicating the temporal transition of the pH value of the surface of the transfer paper that is considered to be one of the factors which influence the contact angle θ that is measured for the transfer X (POD gloss coated paper) after the process of fixing by two types of fixing process (oil applying fixing and oil-less fixing). The pH value is considered to change depending on the density of the hydrophobic functional group which is generated on the surface of the transfer paper. Then, the higher the density of the hydrophobic functional group which exists on the surface of the transfer paper, the smaller the PH value becomes, so that it becomes acidic, the contact angle θ becomes smaller, and the wettability increases. The pH value of the surface of the transfer paper before performing the discharging process is 6.8 for each of the two types of fixing processes (oil applying fixing, oil-less fixing). As shown in FIG. 16, for both of the two types of fixing processes (oil applying fixing, oil-less fixing), after the discharging process is performed, the pH value becomes larger over time, so that after 48 hours, it returns to the pH value before the discharging process (i.e., 6.8). Thus, the pH value returns to the pH value before the discharging process (i.e., 6.8), so that the hydrophobic functional groups produced by the discharging process are considered to have disappeared.

Figure 17:
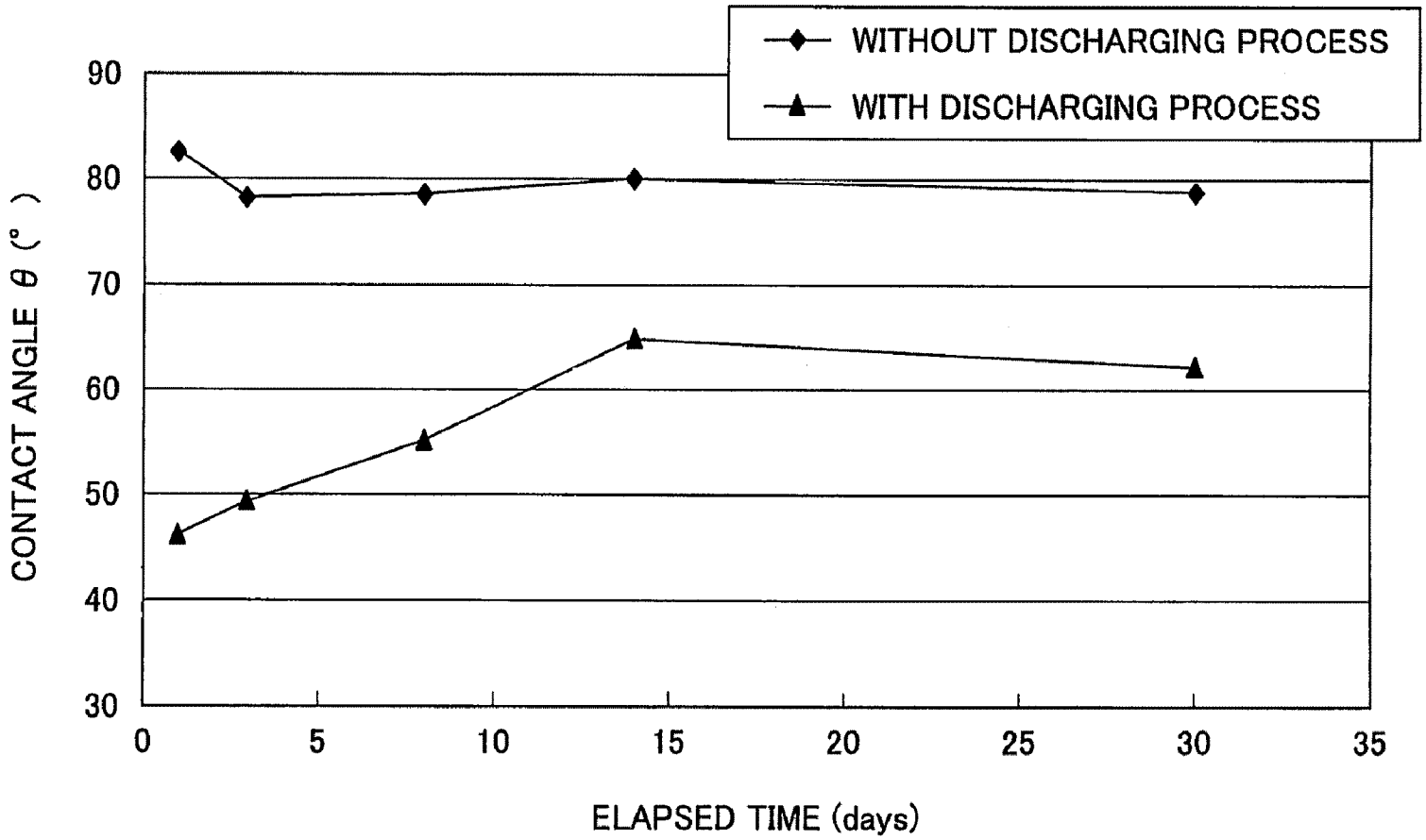
FIG. 17 is a graph which shows a temporal transition of an angle of contact of the surface of the transfer paper that is measured for each of discharged transfer paper and unprocessed transfer paper.

FIG. 17 is a graph indicating temporal transition of the contact angle θ of the surface of the transfer paper X (POD gloss coated paper) that is measured for both a case in which the discharging process is performed and a case in which the discharging process is not performed. The contact angle θ is measured by dropping a pure water liquid droplet on the fixed surface of the transfer paper X. As shown in FIG. 17, when the discharging process is not performed, the contact angle θ of the surface of the transfer paper changes between 78 degrees and 83 degrees, which are not more than 90 degrees. On the other hand, the contact angle θ of the surface of the transfer paper for the case that the discharging process is performed becomes larger over time from 46.6 degrees, which is immediately after the discharging process, but it is held not to exceed 65 degrees, and does not return to the level of the contact angle θ (equaling 78 to 83 degrees) for the case the discharging process is not performed. Based on the results of FIGS. 17 and 16, it is considered that, the reason the contact angle θ of the surface of the transfer paper and the surface of the toner image is held to a low level of not more than 65 degrees and the wettability does not decrease even when the time has elapsed after performing the discharging process is that the contribution of an effect of reduced oil and wax due to the discharging process is large.

Table 5 shows the result of examining correctivity (of a ball-point pen, a pencil, an oily pen, a marker pen, a seal, highlighter, an aqueous pen) before and after discharging process on transfer paper which has fixed thereon a toner image by two types of fixing process (oil applying fixing, oil-less fixing). The correctivity is examined for two types of transfer paper: copying paper ("My Recycle Paper GP"; manufactured by Ricoh Co., Ltd.) and POD gloss coated paper ("Business Coat Gloss 100"; manufactured by Ricoh Co., Ltd.). As shown in Table 5, for both of the two types pf fixing processes (oil applying fixing and oil-less fixing), the correctivity of writing instruments using aqueous ink (a highlighter, an aqueous pen) improves due to the discharging.

TABLE 5

| | BALL-POINT PEN | PENCIL | OILY/ MARKER | SEAL | HIGHLIGHTER | AQUEOUS PEN |
|---|---|---|---|---|---|---|
| DISCHARGING PROCESS: NO OIL APPLYING FIXING | ✓ | ✓ | ✓ | ✓ | x | x |
| DISCHARGING PROCESS: NO OIL-LESS FIXING | ✓ | ✓ | ✓ | ✓ | x | x |
| DISCHARGING PROCESS: YES OIL APPLYING FIXING | ✓ | ✓ | ✓ | ✓ | ✓ | ✓ |
| DISCHARGING PROCESS: YES OIL-LESS FIXING | ✓ | ✓ | ✓ | ✓ | ✓ | ✓ |

✓: ADDING POSSIBLE
x: ADDING DIFFICULT

Figure 18:
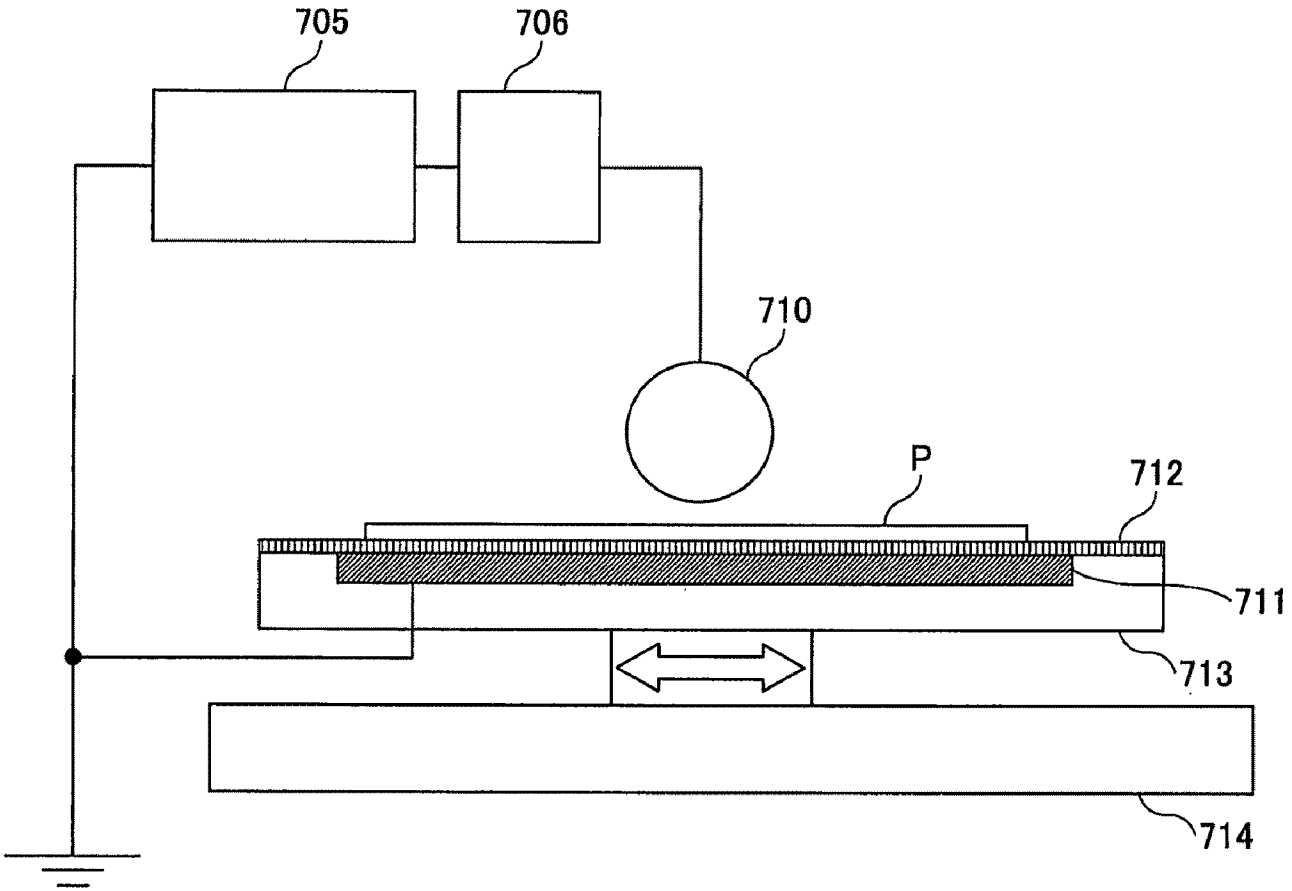
FIG. 18 is a schematic configuration diagram of an experimental device used in confirming an effect of the discharging process.

FIG. 18 is a schematic configuration diagram of the surface processing device used in an experiment to check the effect of discharging process in the image forming device of the present embodiment. The surface processing device may be used as a surface processing device 70 to be embedded into the above-configured image forming device 1 (see FIG. 1) and the below-described transfer material processing device. In FIG. 18, a discharging electrode 710 as a first electrode member is a stainless steel-made round bar with a diameter of 6 mm and a length of 300 mm. A ground electrode 711 as a second electrode member is an aluminum plate with a thickness of 5 mm and a length in the discharge electrode axis direction of 300 mm and is grounded. On the side of the surface on which the transfer paper P of the ground electrode 711 is placed is provided a dielectric 712 which includes a glass plate with a thickness of 1 mm. The ground electrode 711 and the dielectric 712, which are fixed to an insulating pedestal 713 such that the gap between the discharging electrode 710 and the dielectric 712 becomes 1 mm, are to be made to slide below the discharging electrode 710 by an electric slider (EZ limo; manufactured by Oriental Motor Co., Ltd.) 714 at the speed of 500 mm/s in a direction orthogonal to the discharging electrode axis. Here, high frequency high voltage is applied to the discharging electrode 710 by a high frequency transmitter (CT-0212; manufactured by Kasuga Electric Works, Ltd.) and a high voltage transformer (CT-T02W; manufactured by Kasuga Electric Works, Ltd.) 706, discharging is performed with an electric power of 500 W, and transfer paper P of 100% solid image of each color output by the image forming device of the electronic photography scheme is placed on the dielectric 712 to process the transfer paper P. As the image forming device of the electronic photography scheme, two types of color image forming devices (image forming device A: "Pro C900", an on-demand printing device manufactured by Ricoh Co., Ltd.; and image forming device B: "Imagio MP C4000", a digital color multifunctional machine manufactured by Ricoh Co., Ltd.) are used. Then, with the image forming devices A and B, a solid image including toners of yellow (Y), magenta (M), cyan (C), and black (K) is formed on the transfer paper P to be processed.

Table 6 shows a result of coating UV varnish (Daicure Clear-UV-1245; manufactured by DIC Corporation) with No. 4 wired bar onto the transfer paper P onto which a discharging process is performed in the experimental device, and a result of a comparative example of similarly coating unprocessed transfer paper onto which the discharging process is not performed. As shown in Table 6, when the discharging process is performed on either one of the fixed transfer paper P, the varnish may be applied uniformly on the surface of the transfer paper for either of the two types of transfer paper on which individual toner image of each color used in the experiment is formed on, leading to obtaining a satisfactory coating result. On the other hand, in the comparative example in which the discharging process is not performed, the varnish cannot be applied uniformly to the surface of the transfer paper for either of the transfer papers, causing poor coating.

TABLE 6

| | COLOR IMAGE FORMING DEVICE A | | | | COLOR IMAGE FORMING DEVICE B | | | |
|---|---|---|---|---|---|---|---|---|
| | C 100% | M 100% | Y 100% | K 100% | C 100% | M 100% | Y 100% | K 100% |
| DIS-CHARGING PROCESS: YES | ✓ | ✓ | ✓ | ✓ | ✓ | ✓ | ✓ | ✓ |
| DIS-CHARGING PROCESS: NO | X | X | X | X | X | X | X | X |

✓: SATISFACTORY COATING, x :POOR COATING

In the foregoing, according to the present embodiment, the surface processing device 70 processes the fixed transfer paper P on which the toner image is fixed using a fixing member on which a mold release agent including oil is applied, or transfer paper P having fixed thereon a toner image formed using a toner to which is added a mold release agent including wax such that a dielectric barrier discharge is generated on or near the fixed surface of the transfer paper P. In this way, the discharging makes it possible to improve the wettability of the surface of the transfer paper P as well as to reduce oil which exists on the surface of the transfer paper P. Moreover, it is possible to satisfactorily perform a process of coating a varnish or oil, etc., onto the fixed surface of the transfer paper P and to improve the correctivity at the fixed surface of the transfer paper P. Thus, it is not necessary to perform inefficient operation such that the fixed transfer paper P is left as it is for a long time and it is not necessary to use a special varnish or adhesive to which surfactant or alcohol is added for the coating process, thus making it possible to prevent a reduction in operational efficiency and an increased cost.

In particular, according to the present embodiment, a dielectric barrier discharging is generated between the surface of the first electrode member 703 and the surface of the dielectric layer 704*b* of the second electrode roller 704 with the fixed transfer paper P therebetween. This dielectric barrier discharging can be used to generate a discharge such that it is concentrated in an air gap G between the surface of the first electrode member 703 and the surface of the transfer paper P, making it possible to efficiently and accurately generate the discharge on or at the surface of the transfer paper P.

In the above-described embodiment, the surface processing device 70 and the image forming device 1 including the surface processing device 70 according to the present invention are described, but it is not limited to the ones exemplified. The surface processing device according to the present invention may be arranged as in the below-described embodiment, or the present invention may also be applied to the below-described image forming system and transfer material processing device.

Figure 19:
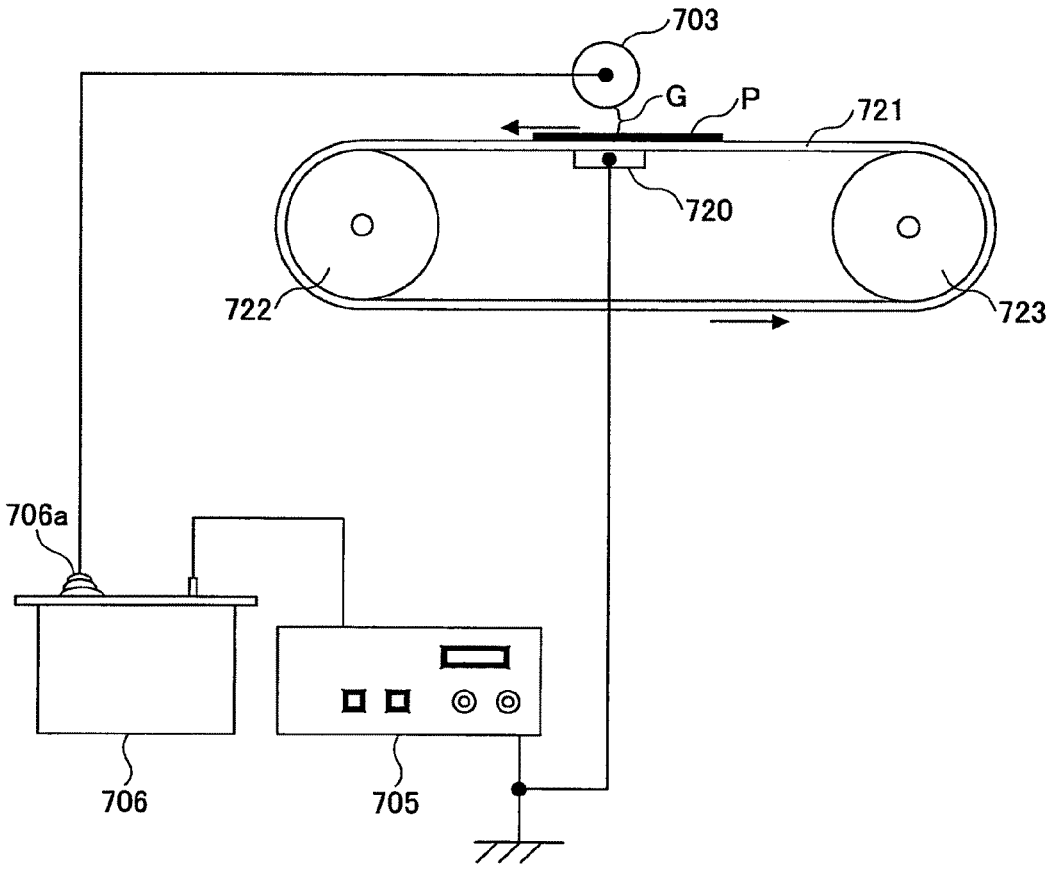
FIG. 19 is a schematic configuration diagram of a surface processing device according to another embodiment of the present invention.

FIG. 19 is a schematic configuration diagram of a surface processing device 70 according to another embodiment of the present invention. In the surface processing device 70 of the present embodiment, an electrode plate 720 which includes an electro-conductive material is used as a second electrode member which opposes a first electrode roller 703. As a material for the electrode plate 720, an aluminum plate may be used, for example. A dielectric belt 721 is stretched across multiple rollers 722 and 723 such that the back face thereof is in contact with the electrode plate 720. Either one of the rollers 722 and 723, as a drive roller, can rotationally drive the dielectric belt 721 to hold, onto the dielectric belt 721, the transfer paper P to be processed to convey the held transfer paper P. In this surface processing device 70, the predetermined alternating voltage can be applied to the first electrode roller 703 to generate a discharge in an air gap G between the first electrode roller 703 and the surface of the transfer paper P conveyed with the dielectric belt 721 and process the surface of the transfer paper P. In the surface processing device 70, an electro-conductive roller may be arranged, in lieu of the electrode plate 720, as a second electrode member which opposes the first electrode roller 703. In this case, the dielectric layer does not have to be provided on the surface of the electro-conductive roller as the second electrode member.

Figure 20:
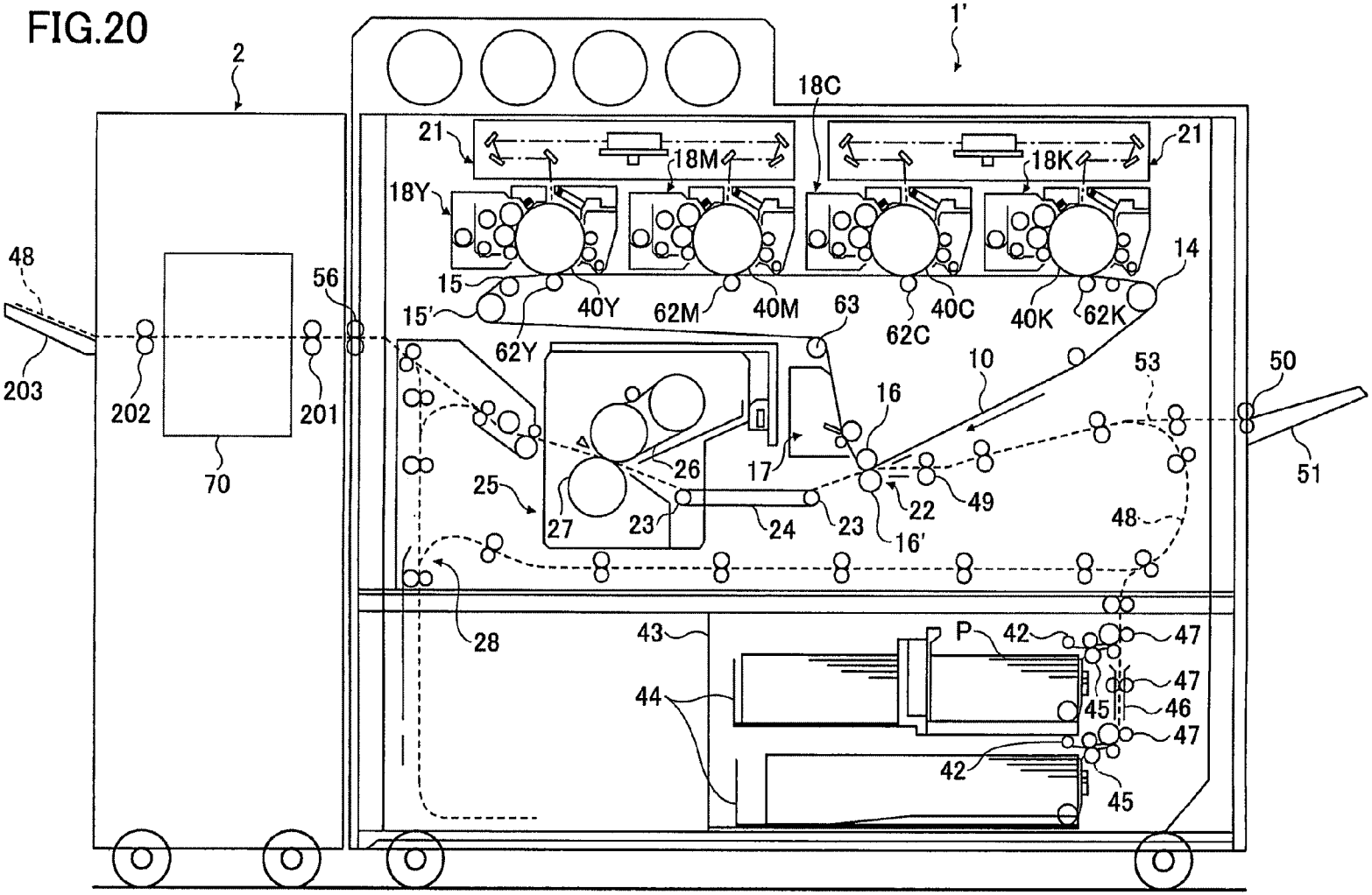
FIG. 20 is a schematic configuration diagram of an image forming system according to a further embodiment of the present invention.

FIG. 20 is a schematic configuration diagram of an image forming system according to a further embodiment of the present invention. The image forming system according to the present embodiment is a combination of a common image forming device 1' without the surface processing device and a transfer material processing device 2 as a peripheral device with the surface processing device. In FIG. 20, the same ones as the image forming device 1 in FIG. 1 as described above may be used for various members and devices which form the image forming device 1', so that the same letters are assigned and the explanations are omitted therefor. The image forming device 1' includes a transfer member output section which is provided with a fixed paper discharging roller pair 56 such that the fixed transfer paper processed at the fixing device is output to the transfer material processing device 2. Moreover, the transfer material processing device 2 which makes up the image forming system according to the present embodiment includes a transfer material input section to which is input the fixed transfer paper output from the image forming device 1', a surface processing device 70 which processes a surface on which the toner image of the transfer material input from the transfer material input section, and a paper-discharge tray 203 as a transfer material output section from which is output a transfer material which has been surface processed at the surface processing device 70. The transfer material input section is provided such that it opposes the transfer material output section which is provided with a fixed paper discharge roller pair 56 of the image forming device 1'. With such a configuration as described above, a transfer paper conveying channel 48 is formed from the paper-feeding location of the paper-feeding cassette 44 of the image forming device 1' to the paper-discharge tray 203 of the transfer material processing device 2. Moreover, the surface processing device 70, which is provided at the transfer material processing device 2 includes a discharging unit which generates a discharge on or near the fixed surface of the transfer paper, so that one having the same configuration as that of the transfer processing device shown in FIG. 18 or FIG. 19 may be used. In the image forming system of the present embodiment, when the toner image is formed at the image forming device 1' and the fixing process is completed, the fixed transfer paper is introduced from the transfer paper output section of the image forming device 1' to within the transfer material processing device 2. When the discharging process is completed at the surface processing device 70 of the transfer material processing device 2, the processed transfer paper P for which wettability has improved is discharged onto the paper-discharge tray 203.

Figure 21:
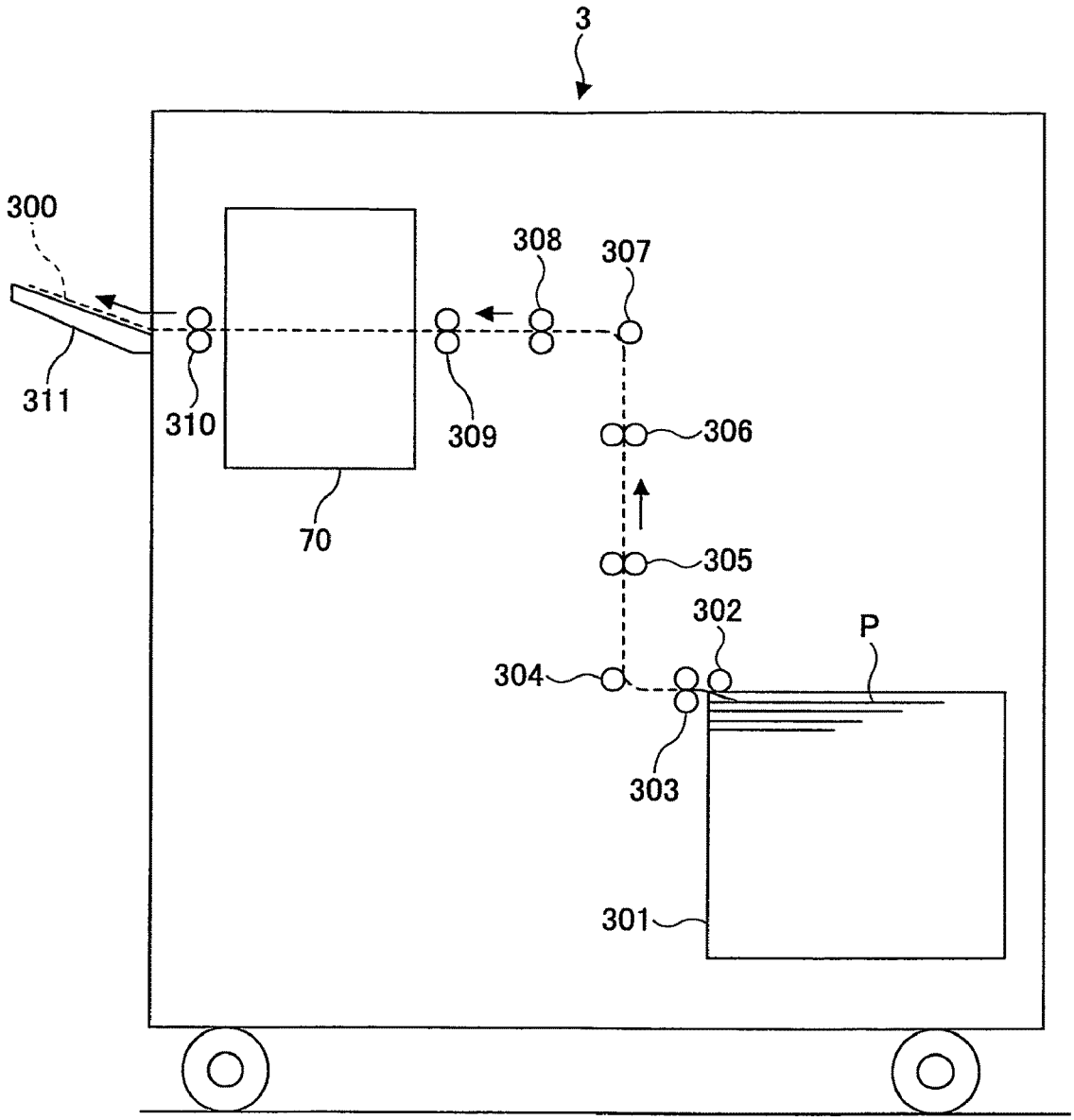
FIG. 21 is a schematic configuration diagram of a transfer material processing device according to a further embodiment of the present invention.

FIG. 21 is a schematic configuration diagram of a transfer material processing device according to a further embodiment of the present invention. The transfer material processing device 3 according to the present embodiment is an independent installation-type device which may be installed independently from the image forming device at a location which is remote from the location at which is installed the image forming device which forms the toner image on the transfer material to be processed. The transfer material processing device 3 includes a paper-feed cassette 301 as a transfer material supplying section which supplies the fixed transfer paper P on which surface the toner image is formed, a surface processing device 70 which processes the surface on which is fixed the toner image of the transfer paper P supplied from the paper-feed cassette 301, and a paper-discharge tray 311 as a transfer material output section from which is output the transfer paper P which is surface processed at the surface processing device 70. The paper-feed cassette 301 carries a bundle of fixed transfer paper P, and topmost transfer paper P in a paper bundle of the paper-feed cassette 301 is sent out as the paper-feed roller 302 is rotationally driven. The transfer paper P sent out from the paper-feed cassette 301 is conveyed to the surface processing device 70 by the paper-feed roller 303 and the conveying rollers 304-309. The transfer paper P which has gone through the discharging process and output at the surface processing device 70 is output onto the paper-discharge tray 311 with the paper-discharge roller 310. With the configuration as described above, a transfer paper conveying channel 300 from a paper-feed location of the paper-feed cassette 301 to the paper-discharge tray 311 is formed. Moreover, also in the present embodiment, the surface processing device 70 includes a discharging unit which generates a discharge on or near the fixed surface of the fixed transfer paper, so that one having the same configuration as that of the transfer processing device shown in FIG. 7, FIG. 18 or FIG. 19 as described above may be used, for example. In the transfer material processing device 3 of the present embodiment, when a multiple number of fixed transfer paper sheets are collectively set onto the paper-feed tray 301, and a user operates a process start button of an operating section (not shown), for example, the multiple number of transfer paper sheets P within the paper-feed cassette 301 is automatically fed sheet by sheet in a successive manner from the top, undergoes a predetermined discharging process at the surface processing device 70, and the processed transfer paper P, which wettability has improved, is continually discharged onto the paper-discharge tray 301.

Figure 22:
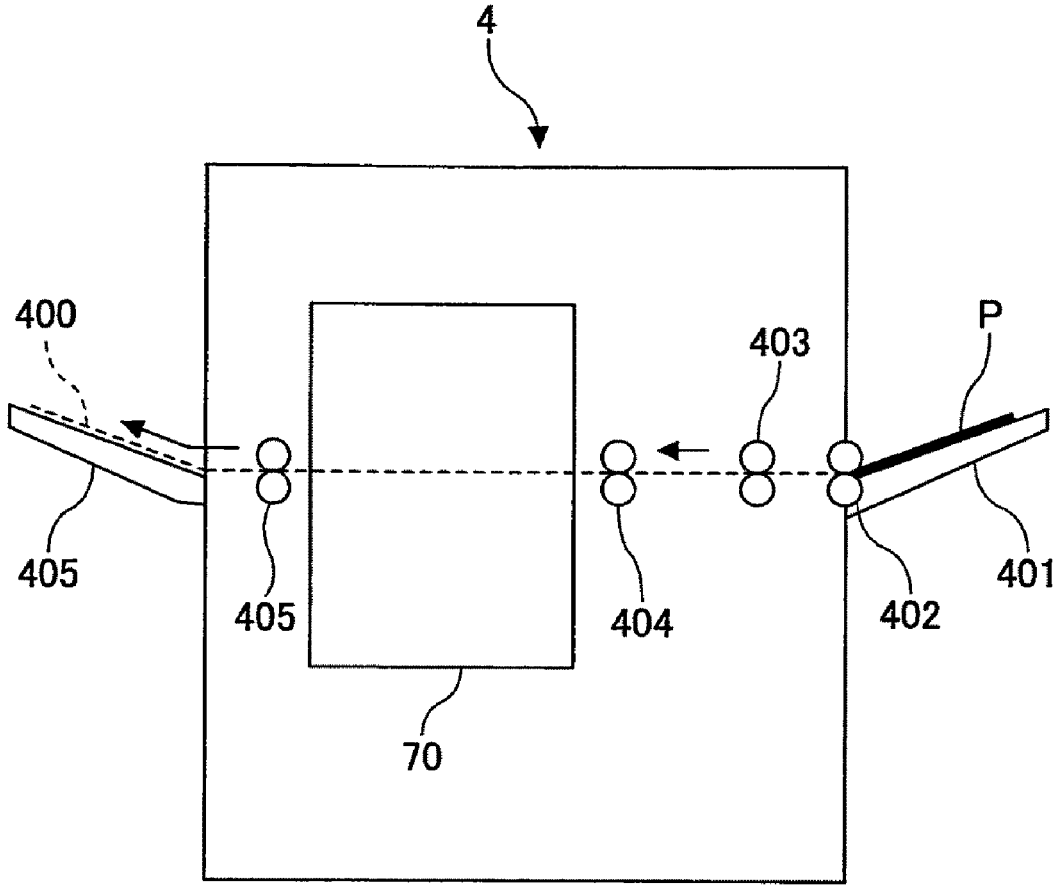
FIG. 22 is a schematic configuration diagram of the transfer material processing device according to a further embodiment of the present invention.

FIG. 22 is a schematic configuration diagram of a transfer material processing device according to a further embodiment of the present invention. In the same manner as the transfer material processing device 3 of FIG. 21, the transfer material processing device 4 of the present embodiment is an independent installation-type device which may be installed independently from the image forming device. Unlike the exemplary configuration of FIG. 21, the transfer material processing unit 4 according to the present embodiment includes a manual tray 401, instead of the paper-feed cassette, as a transfer material supplying section which supplies the fixed transfer paper P. The transfer paper P which is set on the manual tray 401 is sent out to the surface processing device 70 with a manual feeding roller 402, and is introduced into the surface processing device 70 with the conveying roller 404. Moreover, the transfer paper P which has undergone the discharging process and output at the surface processing device 70 is output onto the paper-discharge tray 405 with the paper-discharge roller pair 405. With the configuration as described above, a transfer paper conveying channel 401 from the manual tray 401 to the paper-discharge tray 405 is formed. Moreover, also in the present embodiment, the surface processing device 70 includes a discharging unit which generates a discharge on or near the fixed surface of the fixed transfer paper, so that one having the same configuration as that of the transfer processing device shown in FIG. 7, FIG. 18 or FIG. 19 as described above may be used. In the transfer material processing device 4 according to the present embodiment, the fixed transfer paper is set to the manual tray 401, the transfer paper P on the manual tray 401 is automatically fed based on a sensing of the transfer paper on the manual tray 401 or an operation of a process start button of the operating section (not shown), undergoes a predetermined discharging process at the surface processing device 70, and the processed transfer paper P for which wettability has improved is continually discharged onto the paper-discharge tray 405. In particular, in the transfer material processing unit 4 of the present embodiment, it suffices to place the fixed transfer paper on the manual tray 401, making it possible to process, sheet by sheet, the fixed transfer paper with ease.

In the above-described embodiments, while an example is shown of using a dielectric barrier discharge for the surface processing of the fixed transfer paper, the present invention may use other discharging by high voltage under atmospheric pressure, which is expressed as "atmospheric pressure plasma", "atmospheric pressure glow discharge", "corona discharge", "streamer discharge under atmospheric pressure", etc.

Moreover, in the above-described embodiments, while the transfer material to be processed by the surface processing device 70 is transfer paper with fibrous material as the base, the transfer device to be processed according to the present invention may be a transfer material other than a transfer sheet such as a plastic OHP sheet, etc., as long as it has formed thereon a toner image and it can be fixed, as the same advantages are to be obtained.

Moreover, as a toner which makes up the toner image on the transfer material which can be processed by the surface processing device of the embodiments as described above, a toner for electronic photography may be used that contains at least resin and coloring agent as shown below, for example. Moreover, the toner may contain other, components such as carrier, wax, etc., as needed.

Resin

A resin includes at least a binder resin, for which there is no limit, so that a commonly used resin may be selected appropriately; it may include, for example, vinyl polymers such as styrene monomer, acrylic monomer, methacrylic monomer, etc., monomer thereof or copolymer including two or more types, polyester polymer, polyol resin, phenolic resin, silicone resin, polyurethane resin, polyamide resin, furan resin, epoxy resin, xylene resin, terpene resin, coumarone indene resin, polycarbonate resin, petroleum resin, etc. Taking into account the mechanical strength, etc., polyester resin is preferable.

A styrene monomer includes, for example, styrene such as styrene, o-methyl styrene, m-methyl styrene, p-methyl styrene, p-phenyl styrene, p-ethyl styrene, 2,4-dimethyl styrene, p-n-amyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlor styrene, 3,4-dichlorostyrene, m-nitro styrene, o-nitro styrene, p-nitro styrene, etc., or the derivative thereof.

The acrylic monomer includes, for example, acrylic acids such as acrylic acid, or acrylic acid methyl, acrylic acid ethyl, acrylic acid propyl, acrylic acid n-butyl, acrylic acid isobutyl, acrylic acid n-octyl, acrylic acid n-dodecyl, acrylic acid 2-ethyl hexyl, acrylic acid stearyl, acrylic acid 2-chloroethyl, acrylic acid phenyl, etc., or the esters thereof.

The methacryl monomer includes, for example, methacrylic acids such as methacrylic acid, methacrylic acid methyl, methacrylic acid ethyl, methacrylic acid propyl, methacrylic acid n-butyl, methacrylic acid isobutyl, methacrylic acid n-octyl, methacrylic acid n-dodecyl, methacrylic acid 2-ethyl hexyl, methacrylic acid stearyl, methacrylic acid phenyl, methacrylic acid dimethyl aminoethyl, methacrylic acid diethyl aminoethyl, or the esters thereof.

Examples of other monomers which form vinyl polymer, or copolymer include (1)-(18) below: (1) monoolefins such as ethylene, propylene, butylene, isobutylene, etc.; (2) polyenes such as butadiene, isoprene, etc.; (3) vinyl halides such as vinyl chloride, vinylidene chloride, vinyl bromide, vinyl fluoride, etc.; (4) vinyl esters such as vinyl acetate, propionic acid vinyl, benzoic acid vinyl, etc.; (5) vinyl ethers such as vinyl methyl ether, vinyl ethyl ether, vinyl isobutyl ether, etc.; (6) vinyl ketones such as vinyl methyl ketone, vinyl hexyl ketone, methyl isopropenyl ketone, etc.; (7) N-vinyl compounds such as N-vinyl pyrrole, N-vinyl carbazole, N-vinyl indole, a N-vinyl pyrrolidone, etc.; (8) vinyl naphthalenes; (9) acrylic acid or methacrylic acid derivative such as acrylonitrile, methacrylonitrile, acrylic amide, etc.; (10) unsaturated dibasic acid such as maleic acid, citraconic acid, itaconic acid, alkenyl succinic acid, fumaric acid, mesaconic acid, etc.; (11) unsaturated dibasic acid anhydride such as maleic acid anhydride, citraconic acid anhydride, itaconic acid anhydride, alkenyl succinic acid anhydride, etc.; (12) unsaturated dibasic acid monoester such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, mesaconic acid monomethyl ester, etc.; (13) unsaturated dibasic acid ester such as dimethyl maleic acid, dimethyl fumaric acid, etc.; (14) α,β-unsaturated acid such as crotonic acid, cinnamic acid, etc.; (15) α,β-unsaturated acid anhydride such as crotonic acid anhydride, cinnamic acid anhydride, etc.; (16) monomer having carboxyl group such as anhydride of the α,β-unsaturated acid and lower fatty acid, alkenyl malonic acid, alkenyl glutaric acid, alkenyl adipic acid, acid anhydride thereof, and monoester thereof etc.; (17) acrylic acid or methacrylic acid hydroxy alkyl esters such as 2-hydroxyethyl acrylate, 2-hydroxyethyl methacrylate, 2-hydroxypropyl methacrylate, etc.; and (18) monomer having hydroxy group such as 4-(1-hydroxy-1-methyl butyl) styrene, 4-(1-hydroxy-1-methyl hexyl) styrene.

Moreover, in a toner of the present embodiment, copolymer or vinyl polymer of binder resin may have a bridging structure bridged with a bridging agent having two or more vinyl groups. The bridging agent used in this case as an aromatic divinyl compound includes divinylbenzene, divinylnaphthalene, for example. Diacrylate compounds linked by alkyl chain includes, for example, ethylene glycol diacrylate, 1,3-butylene glycol diacrylate, 1,4-butanediol diacrylate, 1,5-pentanediol diacrylate, 1,6-hexandiol diacrylate, neopentyl glycol diacrylate, these compounds with acrylate replaced by methacrylate, etc. Diacrylate compounds linked by alkyl chain including ether linkage includes, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, these compounds with acrylate replaced by meta acrylate, etc.

Moreover, dimethacrylate compound, diacrylate compound linked by a chain including ether linkage and aromatic group are also included. Polyester diacrylates includes, for example, a product under the name of MANDA (manufactured by Nihon Kayaku Co., Ltd.).

A multi-functional bridging agent includes pentaerythritol triacrylate, trimethylol ethane triacrylate, trimethylol propane triacrylate, tetramethylol methane tetra acrylate, oligoester acrylate, these compounds with acrylate replaced by methacrylate, triallyl cyanurate, triallyl trimellitate.

For 100 parts by weight of other monomer component, it is preferable to use 0.01-10 parts by weight of these bridging agents and it is more preferable to use 0.03-5 parts by weight of these bridging agents. Among these bridging monomers, from points of view of fixability and offset resistance of resin for toner, what are preferable include diacrylate compounds linked by a linking chain including one ether linkage and aromatic group, aromatic divinyl compound (divinylbenzene, in particular). Of these, what is preferable is a combination of monomers such that it becomes styrene copolymer, styrene-acrylic copolymer.

A polymerization initiator used for manufacturing the vinyl polymer or copolymer includes, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2 methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethyl pentane), 2-phenylazo-2',4'-dimethyl-4'-methoxyvaleronitrile, 2,2'-azobis(2-methyl propane), ketone peroxides such as methyl ethyl ketone peroxide, acetylacetone peroxide, cyclohexanone peroxide, 2,2-bis(tert-butylperoxy) butane, tert-butyl hydroperoxide, cumene hydroperoxide, 1,1,3,3-tetra methyl butyl hydroperoxide, di-tert-butyl peroxide, tert-butyl cumyl peroxide, dicumyl peroxide, α-(tert-butyl peroxy) isopropyl benzene, isobutyl peroxide, octanoyl peroxide, decanoyl peroxide, lauroyl peroxide, 3,5,5-trimethylhexanoyl peroxide, benzoyl peroxide, m-tolyl peroxide, diisopropyl peroxydicarbonate, di-2-ethylhexyl peroxy dicarbonate, di-n-propyl peroxy dicarbonate, di-2-ethoxyethyl peroxy dicarbonate, di-ethoxy isopropyl peroxy dicarbonate, di(3-methyl-3-methoxybutyl) peroxy carbonate, acetyl cyclohexylsulfonyl peroxide, tert-butylperoxy acetate, tert-butylperoxy isobutyrate, tert-butylperoxy-2-ethyl hexarate, tert-butylperoxy laurate, tert-butyl oxybenzoate, a tert-butylperoxy isopropyl carbonate, di-tert-butylperoxy isophthalate, tert-butylperoxy allyl carbonate, isoamyl peroxy-2-ethylhexanoate, di-tert-butylperoxy hexahydro terephthalate, tert-butylperoxyazelate, etc.

When the binder resin is styrene-acrylic resin, a resin having a molecular weight distribution by GPC of tetrahydrofuran (THF) soluble resin component with at least one peak in a region of molecular weight of 3000-50000 (converted to number average molecular weight) and with at least one peak in a region of molecular weight of no less than 100000 is preferable from points of view of fixability, offset resistance, and maintainability. Moreover, for the THF soluble content, a binder resin with the component not more than 100000 making up 50-90% of the molecular weight distribution is preferable, a binder resin with a main peak in a region of the molecular weight of 5000-30000 is more preferable, and a binder resin with a main peak in a region of the molecular weight of 5000-20000 is most preferable For an acid value when the binder resin is a vinyl polymer such as styrene-acrylic resin, 0.1 mgKOH/g-100 mgKOH/g is preferable, 0.1 mgKOH/g-70 mgKOH/g is more preferable, and 0.1 mgKOH/g-50 mgKOH/g is most preferable.

Monomer which makes up the polyester polymer includes the following.

The divalent alcohol component includes, for example, ethylene glycol, propylene glycol, 1,3-Butanediol, 1,4-Butanediol, 2,3-Butanediol, diethylene glycol, triethylene glycol, 1,5-pentanediol, 1,6-hexanediol, neopentyl glycol, 2-ethyl-1,3-hexane diol, diol obtained from cyclic ether such as ethylene oxide, propylene oxide, etc., polymerizing with hydrogenated bisphenol A, or bisphenol A.

In order to bridge the polyester resin, it is preferable to use at least trivalent alcohol as well. A polyhydric alcohol which is at least trivalent includes sorbitol, 1,2,3,6-hexane tetrol, 1,4-sorbitan, pentaerythritol, e.g., dipentaerythritol, tripentaerythritol, 1,2,4-butanetriol, 1,2,5-pentatriol, glycerol, 2-methyl propane triol, 2-methyl-1,2,4-butanetriol, trimethylolethane, trimethylolpropane, 1,3,5-trihydroxybenzene, etc.

Acid component which forms the polyester polymer includes, for example, benzene dicarboxylic acids or the anhydride such as phthalic acid, isophthalic acid, terephthalic acid, etc.; alkyl dicarboxylic acids or the anhydride such as succinic acid, adipic acid, sebacic acid, azelaic acid, etc.; unsaturated dibasic acid such as maleic acid, citraconic acid, itaconic acid, alkenyl succinic acid, fumaric acid, mesaconic, acid; or unsaturated dibasic acid anhydride such as maleic anhydride, citraconic anhydride, itaconic anhydride, alkenyl succinic acid anhydride, etc. Moreover, a component of multivalent carboxylic acid which is at least trivalent includes trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-methylene carboxy propane, tetra (methylene carboxy) methane, 1,2,7,8-octane tetracarboxylic acid, Empol trimer acid or anhydride thereof, partially lower alkyl ester, etc.

When the binder resin is polyester resin, the THF soluble resin content with at least one peak of the molecular weight distribution in a region of the molecular weight of 3000-

50000 is preferable from points of view of toner fixability and offset resistance, and, for the THF soluble content, a binder resin with component not more than 100000 making up 60-100% of the molecular weight distribution is preferable, and a binder resin with at least one peak of the molecular weight distribution in a region of the molecular weight of 5000-20000 is more preferable. This distribution of the molecular weight of the binder resin is measured by gel permeation chromatography (GPC) with THF as a solvent.

For an acid value when the binder resin is polyester resin, 0.1 mgKOH/g-100 mgKOH/g is preferable, 0.1 mgKOH/g-70 mgKOH/g is more preferable, and 0.1 mgKOH/g-50 mgKOH/g is most preferable.

Moreover, a resin which includes, in at least either of vinyl polymer and polyester resin components, a monomer component which may react to the resin components may also be used as a binder resin usable in a toner of the present embodiment. A monomer which forms the polyester resin component that may react to the vinyl polymer includes, for example, unsaturated dicarboxylic acid such as phthalic acid, maleic acid, citraconic acid, itaconic acid, etc., and anhydrate thereof. A monomer which forms the vinyl polymer component includes what has a carboxyl group or hydroxy group, and acrylic acid or methacrylic acid esters.

Moreover, polyester polymer, vinyl polymer and the other binder resins that are used together preferably have not less than 60 weight % of resin with an acid value of the whole binding resin of 0.1-50 mgKOH/g.

The acid value of the binder resin component of the toner composition is determined according to the following method, the basic operation of which complies with JIS K-0070.

(1) The sample is to be used after removing additives other than binding resin (polymer component) in advance, or content and acid value of component than the bridged binding resin and the binding resin are determined in advance. A crushed sample of 0.5-2.0 g is precisely weighed, and the weight of the polymer component is assumed as Wg. For example, when the acid value of the binder resin is to be measured from the toner, the content and acid value of the coloring agent or the magnetic material, etc. are measured separately and then the acid value of the binder resin is determined by calculation.

(2) A sample is placed in a 300 ml beaker, a mixed liquid of 150 ml of toluene/ethanol (volume ratio of 4/1) is added, and dissolved.

(3) Using an ethanol solution, c(KOH)=0.1 mol/L, titration is performed using a potential difference titration device.

(4) The amount of the KOH solution used at this time is set to be S (ml), and a blank is measured at the same time, and the amount of the KOH solution used at this time is set to be B (ml), and calculation is carried out using the following equation (1). F is a KOH factor.

$$\text{Acid value (mgKOH/g)}=[(S-B)\times f\times 5.61]/W \quad (1)$$

The binder resin and the composition which includes the binder resin of the toner has a glass transition temperature (Tg) of 35-80 degrees Celsius preferably and of 40-75 degrees Celsius more preferably from the point of view of toner maintainability. When Tg is lower than 35 degrees Celsius, toner may likely deteriorate under high temperature atmosphere, and an offset may likely occur at the time of fixing. Moreover, when Tg exceeds 80° C., the fixability may decrease.

A magnetic material may be contained in the toner. The magnetic material includes, for example, (1) magnetic iron oxide such as magnetite, maghemite, ferrite, and iron oxide including oxide of other metals; (2) metals such as iron, cobalt, metal, nickel, etc., or alloy of these metals and metals such as aluminum, cobalt, copper, lead, magnesium, tin, zinc, antimony, beryllium, bismuth, cadmium, calcium, manganese, selenium, titanium, tungsten, vanadium, etc. (3) and mixture thereof, etc.

Specific examples of the magnetic material include $Fe_3O_4$, $\gamma$-$Fe_2O_4$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, nickel powder, etc. These magnetic materials may be, used alone or in combination. Of these, fine powders of triiron tetroxide and $\gamma$-iron sesquioxide are particularly preferable.

Moreover, magnetic iron oxide such as magnetite, maghemite, ferrite, etc, that contains different kinds of elements, or a mixture thereof may also be used. Examples of different kinds of elements include, for example, lithium, beryllium, boron, magnesium, aluminum, silicon, phosphorus, germanium, zirconium, tin, sulfur, calcium, scandium, titanium, vanadium, chrome, manganese, cobalt, nickel, copper, zinc, gallium, etc. The different kinds of elements that are preferable are those selected from magnesium, aluminum, silicon, phosphorus, and zirconium. The different kinds of elements may be incorporated into a crystal lattice of the iron oxide, they may be incorporated into the iron oxide as an oxide, or they may exist on the surface as an oxide or hydroxide, but they are preferably contained as an oxide.

The different kinds of elements may be incorporated into a particle by making salt of different kinds of elements coexist at the time of producing the magnetic material and adjusting the pH. Moreover, they may be deposited onto the particle surface by adjusting the PH after producing the magnetic substance particle, or adding salt of each element and adjusting the pH.

As an amount of the magnetic material used, for a binder resin of 100 parts by weight, a magnetic material of parts by weight is, preferably, 10-200 and more preferably, 20-150. A number average particle diameter of these magnetic materials is, preferably, 0.1-2 μm, and, more preferably, 0.1-0.5 μm. The number average diameter may be determined by measuring, with a digitizer, etc., a photograph taken in an expanded manner by a transmission electron microscope. Moreover, as a magnetic characteristic of the magnetic material, it is preferable to have coercive force of 20-150 oersteds, saturation magnetization of 50-200 emu/g, and residual magnetization of 2-20 emu/g for the magnetic characteristic with 10K oersteds applied. The magnetic material may also be used as a coloring agent.

Coloring Agent

There is no particular limit on a coloring agent contained in the toner, so that a normally used resin may be appropriately selected for use, including carbon black, nigrosin dye, iron black, naphthol yellow S, Hansa yellow (10G, 5G, G), cadmium yellow, yellow iron oxide, loess, chrome yellow, titanium yellow, Polyazo yellow, oil yellow, Hansa yellow (GR, A, RN, R), pigment yellow L, benzidine yellow (G, GR), permanent yellow (NCG), Balkan fast yellow (5G, R), tartrazine lake, quinoline yellow lake, "ansurazan" yellow BGL, iso-indolinone yellow, blood red, minium, lead vermilion, cadmium red, cadmium mercury red, antimony vermilion, permanent red 4R, para red, "faise" red, parachlorortho nitroaniline red, lithol fast scarlet G, brilliant fast scarlet, brilliant carmine BS, permanent red (F2R, F4R, FRL, FRLL, F4RH), fast scarlet VD, Vulcan Fast Rubine B, brilliant scarlet G, Lithol Rubine GX, permanent red FSR, brilliant carmine 6B, pigment scarlet 3B, Bordeaux 5B, toluidine maroon, permanent Bordeaux F2K, Helio Bordeaux BL, Bordeaux 10B, BON maroon light, BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, "perinon" orange, oil orange, cobalt blue, cerulean blue, alkali blue lake, peacock blue lake, victoria blue lake, organic phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, hydrozincite, "ritobon" and mixtures thereof.

The content of the coloring agent with respect to the toner is preferably 1-15 weight % and more preferably 3-10 weight %.

Moreover, the coloring agent used for the toner in the present embodiment may also be used as a masterbatch conjugated with resin. A binder resin for use in manufacturing the masterbatch or binder resin blended with the masterbatch, besides the previously-listed modified and unmodified polyester resin, includes, for example, polymer of styrene such as polystyrene, poly-p-chlorostyrene, polyvinyl toluene, etc., and substitution product thereof; styrene copolymer such as styrene-p-chlorostyrene copolymer, styrene-propylene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-methyl methacrylic acid methyl copolymer, styrene-methacrylic acid ethyl copolymer, styrene-methacrylic acid butyl copolymer, styrene-α-chrol methacrylic acid methyl copolymer, styrene-acrylonitrile copolymer, styrene-vinyl methyl ketone copolymer, styrene-butadiene copolymer, styrene-isoprene copolymer, styrene-acrylonitrile-indene copolymer, styrene maleic acid copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, paraffin wax, etc. The binder resin may be used alone or in combination.

The masterbatch may be obtained by applying high shear power on the coloring agent and the resin for the masterbatch to mix and blend them. Here, an organic solvent may be used to enhance interaction between the coloring agent and the resin. Moreover, a so-called flushing method in which aqueous paste, including water, of a coloring agent is mixed and blended with the resin and the organic solvent, the coloring agent is shifted to the resin side, and the water and organic solvent component is removed makes it possible to use a wet cake of the coloring agent as it is, eliminating the need for drying, so that it is preferably used. In order to carry out mixing and blending, a high shear dispersion device such as a three roll mill, etc., is preferably used.

As an amount of the masterbatch used with respect to 100 parts by weight of binder resin, 0.1-20 parts by weight is preferable.

Moreover, the resin for the masterbatch preferably has an acid value of not more than 30 mgKOH/g, an amine value of 1-100, and is used by dispersing the coloring agent, and more preferably has an acid value of not more than 20 mgKOH/g, an amine value of 1-50, and is used by dispersing the coloring agent. When the acid value exceeds 30 mgKOH/g, the chargeability under high humidity may decrease, and dispersibility of the pigment may also become insufficient. Moreover, also when the amine value is less than 1 and the amine value exceeds 100, the dispersibility of the pigment may be become unsatisfactory. Moreover, the acid value may be measured by a method described in JIS K0070, and the amine value may be measured by a method described in JIS K7237.

Moreover, a toner dispersing agent preferably is highly compatible with the binder resin from the point of view of pigment dispersibility; Specific commercial items include "Ajisper PB821", "Ajisper PB822" (manufactured by Ajinomoto Fine-Techno Co., Ltd.), "Disperbyk-2001" (manufactured by BYK-Chemie GmbH), "EFKA-4010" (manufactured by EFKA Co.), etc.

The dispersing agent is preferably blended into the toner at the ratio of 0.1-10 weight % with respect to the coloring agent. When the blending ratio is less than 0.1 weight %, the pigment dispersibility may become insufficient, while when it is greater than 10 weight %, the chargeability under high humidity may decrease.

The weight average molecular weight of the dispersing agent is preferably 500-100000 in molecular weight of the maximum value of a main peak with styrene conversion weight in gel permeation chromatography, and is more preferably 3000-100000 from the point of view of pigment dispersibility. More specifically, it is preferably 5000-50000, and is more preferably 5000-30000. When the molecular weight is less than 500, the polarity may increase and the dispersibility of the coloring agent may decrease and, when the molecular weight exceeds 100000, the affinity with the solvent may increase and the dispersibility of the coloring agent may decrease.

The added amount of the dispersing agent is preferably 1-200 parts by weight with respect to a coloring agent 100 parts by weight, and more preferably 5-80 parts by weight. When it is less than 1 part by weight, dispersion power may decrease, while when it exceeds 200 parts by weight, the chargeability may decrease.

Wax

Moreover, as described above, a toner which forms a toner image on a transfer material which can be processed with the surface processing device of the above embodiment may be a toner which contains wax as well as binder resin and coloring agent.

The wax is not particularly limited, so that a commonly-used one may be appropriately selected for use; the wax includes, for example, aliphatic hydrocarbon wax, such as low molecular weight polyethylene, low molecular weight polypropylene, polyolefin wax, microcrystalline wax, paraffin wax, Sasol wax, etc.; oxide of aliphatic hydrocarbon wax, such as oxidized polyethylene wax or block copolymer thereof; plant wax, such as Candelilla wax, carnauba wax, tree wax, jojoba wax, etc.; animal wax such as bees wax, lanolin, whale wax; mineral wax, such as ozocerite, ceresin, petrolatum, etc.; waxes which have fatty acid ester such as montanic acid ester wax, castor wax, etc., as a main component thereof; and partially or wholly deoxidated fatty acid ester such as deoxidated carnauba wax, etc.

The wax may further include, for example, saturated straight fatty acid such as palmitic acid, stearic acid, montanic acid, straight alkyl carboxylic acids further including straight alkyl group, etc.; unsaturated fatty acids such as brassidic acid, eleostearic acid, parinaric acid, etc.; saturated alcohol such as stearyl alcohol, eicosyl alcohol, behenyl alcohol, carnaubil alcohol, ceryl alcohol, mesilyl alcohol, long-chain alkyl alcohol, etc.; polyalcohol such as sorbitol, etc.; fatty acid amide such as linoleic acid amide, olefinic acid amide, lauric acid amide, etc. saturated fatty acid bisamide such as methylene bis-capric acid amide, ethylene bis-lauric acid amide, hexamethylene bis-stearic acid amide, etc.; unsaturated fatty acid amide such as ethylene bisoleic acid amide, hexamethylene bisoleic acid amide, N,N'-dioleyl adipic acid amide, N,N'-dioleyl sebacic acid amide, etc.; aromatic bisamide such as m-xylene bis-stearic acid amide, N,N'-distearyl isophthalic acid amide; metallic salt of fatty acid, such as calcium stearate, calcium laurate, zinc stearate, magnesium stearate, etc.; wax wherein aliphatic hydrocarbon wax is grafted by using vinyl monomer such as styrene and acrylic acid, etc.; partially esterified compound of polyalcohol and fatty acid such as behenic acid monoglyceride, etc.; and methylester compound having hydroxyl group, obtained by hydrogenating vegetable oil.

A more preferable example includes polyolefin obtained by radical-polymerizing olefin under high pressure; polyolefin obtained by purifying a low-molecular-weight by-product obtained at the time of polymerizing high-molecular-weight polyolefin; polyolefin polymerized under low pressure using a catalyst such as Ziegler catalyst and metallocene catalyst; polyolefin polymerized using radiation, electromagnetic wave or light; low-molecular-weight polyolefin obtained by thermally decomposing high-molecular-weight polyolefin; paraffin wax; microcrystalline wax; Fischer-Tropsch wax; synthetic hydrocarbon wax synthesized by Synthol process, Hydrocol process, Arge process, etc.; synthetic wax having a compound of one carbon atom as monomer; hydrocarbon wax having functional group such as hydroxyl group or carboxyl group; mixture of hydrocarbon wax and hydrocarbon wax having functional group; and wax which underwent graft modification by vinyl monomer such as styrene, ester maleate, acrylate, methacrylate and maleic anhydride, etc.

Moreover, what is also preferably used includes wax such that molecular weight distribution thereof is sharpened by using press sweating process, solvent method, recrystallization method, vacuum distillation method, supercritical gas extraction method or solution crystallization method; and wax from which low-molecular-weight solid fatty acid, low-molecular-weight solid alcohol, low-molecular-weight solid compound and other impurities are removed.

In order to balance between fixability and offset resistance, the melting point of the wax is preferably 70-140 degrees Celsius, and more preferably 70-120 degrees Celsius. Blocking resistance may decrease under 70 degrees Celsius, and offset resistance effect may less likely be achieved over 140 degrees Celsius.

Moreover, two or more different types of waxes may be used together to simultaneously achieve both plasticizing and mold-releasing actions, each of which is a wax action.

The type of waxes that has the plasticizing action includes, for example, a wax with a low melting point, a wax with a branched molecular structure, and a wax with a polar group in the structure thereof, etc.

The wax which has the mold-releasing action includes, for example, a wax with a high melting point, the structure of which molecule is of a straight molecular structure, and a nonpolar wax without any functional group. As an example of use, there are a combination of two or more different types of waxes between which the difference of the melting points thereof is 10-100 degrees Celsius; and a combination of polyolefin and graft-modified polyolefin.

When selecting two types of waxes, in a case of the waxes having a similar structure, the wax which has a relatively lower melting point achieves the plasticizing action, while the wax which has a relatively higher melting point achieves the mold-releasing action. At that time, when the difference of the melting points is 10-100 degrees Celsius, the functional separation is effectively achieved. At below 10 degrees Celsius, the effect of the functional separation may be less likely to be achieved, and at above 100 degrees Celsius, a functional interaction is less likely to be achieved. In such a case, the effect of the functional separation becomes likely to be achieved, so that the melting point of at least one of the waxes is preferably 70-120 degrees Celsius and more preferably 70 to 100 degrees Celsius.

Relatively speaking, a wax which has a branched structure, a wax which has a polar group such as a functional group, or a wax which is modified by an component which is different from the main component achieves the plasticizing action, while a wax which has a straight molecular structure, a wax which is non-polar and without any functional group or a wax which is unmodified and straight achieves the mold-releasing action. A preferable example includes, for example, a combination of polyethylene homopolymer or copolymer having ethylene as a main component and polyolefin homopolymer or copolymer having olefin other than ethylene as a main component; combination of polyolefin and graft-modified polyolefin; a combination of hydrocarbon wax and alcohol wax, fatty acid wax or ester wax; a combination of Fischer-Tropsch wax or polyolefin wax and paraffin wax or microcrystalline wax; a combination of Fischer-Tropsch wax and polyolefin wax; a combination of paraffin wax and microcrystalline wax; and a combination of hydrocarbon wax and carnauba wax, candelilla wax, rice bran wax or montan wax.

In either of the cases, this makes it easier to balance between the maintainability and the fixability of the toner, so that in an endothermic peak observed in the DSC measurement of the toner, the peak-top temperature of the maximum peak is preferably within 70-110 deg. C. and more preferably within 70-110 deg. C.

A total content of the wax, with respect to 100 parts by weight of binder resin, is preferably 0.2-20 parts by weight and is more preferably 0.5-10 parts by weight.

For the wax contained in the toner of the present embodiment, the peak-top temperature of the maximum peak in the endothermic peak of the wax measured in DSC (differential scanning calorimetry) is assumed as a melting point of the wax.

With respect to the DSC measurement equipment of the wax or the toner, it is preferable to conduct the measurement with a high-precision intraheater power-compensation type differential scanning calorimeter. As a measurement method, a method compliant with JIS K7121 is adopted, for example. For the DSC curve, after raising and lowering the temperature once and history is recorded in advance, what is measured when raising temperature at a rate of temperature increase of 10 degree Celsius/minute is used.

Charge Controlling Agent

There is no particular limit with respect to a charge controlling agent for a toner, so that it can be appropriately selected from what is known depending on purpose, but, as a color tone may change when a colored material is used, a material which is colorless or white is preferable, including, for example, triphenylmethane dye, molybdic acid chelate pigment, Rhodamine dye, alkoxy amine, quaternary ammonium salt (including fluorine-modified quaternary ammonium salt), alkylamide, phosphor and compound thereof, tungsten and compound thereof, fluorine activator, and metal salt of salicylic acid and of salicylic acid derivative, etc. These may be used alone or in combination.

Moreover, the charge controlling agent to be added to the toner is used, for example, to adjust the charging characteristic of the toner and to suppress the difference in charging characteristic under the environment in which the charging characteristic may change greatly, e.g., under high-temperature and high-humidity, or low-temperature and low-humidity, and to suppress variation in the charge amount between toner particles.

The charge control agent to be used may be a commercial item, which includes, for example, Bontron P-51 (Quaternary ammonium salts), E-82 (oxynaphthoic acid type metal complex), E-84 (salicylic acid type metal complex) and E-89 (phenol type condensation products), which are manufactured by Orient Chemical Industries Co. Ltd.; TP-302 and TP-415 (quaternary ammonium salts molybdenum complex), which are manufactured by Hodogaya Chemical Co. Ltd.; Copy Charge PSY VP2038 (quaternary ammonium salts), Copy Blue PR (triphenylmethane derivatives), Copy Charge NEG VP2036 (quaternary ammonium salts) and Copy Charge NX VP434 (quaternary ammonium salts), which are manufactured by Hoechst AG; LRA-901 and LR-147 (boron complex), which are manufactured by Japan Carlit Co. Ltd.; quinacridone; azo type pigments; and polymer compounds having a functional group such as sulfonic acid group, carboxyl group, quaternary ammonium salt group, etc. The charge controlling agent may be dissolved and/or dispersed after fusing and blending with the masterbatch, or may be added directly to the organic solvent with each component of the toner at the time of dissolving and/or dispersing, or may be fixed onto the toner surface after manufacturing the toner particle.

The content of the charge controlling agent in the toner differs depending on the type of the binder resin, whether there are any additives, a method of dispersion, etc., so that it cannot be specified unconditionally, but, is preferably, for example, 0.1-10 parts by weight, and more preferably 0.2-5 parts by weight, with respect to 100 parts by weight of the binder resin. When the content is below 0.1 parts by weight, the charge controllability may not be obtained, while when it is above 10 parts by weight, the chargeability of the toner may become too large, so that the effect of the main charge controlling agent may be reduced, increasing the electronic absorbing force with a developing roller, causing a reduced flowability of a developing agent or a decreased image density.

Flowability Improving Agent

The toner of the present embodiment may be added a flowability improving agent. The flowability improving agent is to improve the flowability of the toner (or to make it easier for the toner to flow) by adding it onto the toner surface.

The flowability improving agent includes, for example, alumina processed, titanium oxide processed, silica processed such that silane coupling agent, titanium coupling agent, or silicone oil is used to apply surface processing on fine powder alumina, fine powder titanium oxide, fine powder silica such as wet process silica, dry process silica, fluorinated resin powder such as polytetrafluoroethylene fine powder, vinylidene fluoride fine powder, carbon black. Of these, the fine powder alumina, the fine powder titanium oxide, and the fine powder silica are preferable and the silica processed such that the silane coupling agent, or the silicone oil is used to apply surface processing thereon is more preferable.

A particle diameter of the flowability improving agent, as an average primary particle diameter, is preferably 0.001-2 μm and more preferably 0.002-0.2 μm.

The fine powder silica, which is fine powder generated by vapor phase oxidation of silicon halogen compound, is known as a so-called dry method silica or fumed silica.

Commercially available fine powder silica which is generated by the vapor phase oxidization of the silicon halogen compound includes, for example, AEROSIL (name of product of Nippon Aerosil Co., Ltd.) -130, -300, -380, -TT600, -MOX170, -MOX80, -COK84: Ca—O—SiL (name of product of CABOT Co.) -M-5, -MS-7, -MS-75, -HS-5, -EH-5, Wacker HDK (name of product of WACKER-CHEMIE AG)-N20 V15, -N20E, -T30, -T40: D-C Fine Silica (name of product of Dow Corning Co.); Fransol (name of product of Fransil Co.), etc.

Moreover, processed silica powder is more preferable which is a silica fine powder generated by the vapor phase oxidation of a silicon halogen compound that underwent a hydrophobing process. In the processed silica fine powder, a silica fine powder is particularly preferable which is processed such that a degree of hydrophobing that is measured by a methanol titration test preferably shows a value of 30-80%. Hydrophobing is provided by chemically or physically processing with organic silicon compound, etc., which reacts to or physically adsorbs to the silica fine powder. A method is preferred which processes, with the organic silicon compound, the silica fine powder which is generated by the vapor phase oxidization of the silica halogen compound.

The organic silicon compound includes hydroxypropyl trimethoxysilane, phenyltrimethoxysilane, n-hexadecyl trimethoxysilane, n-octadecyl trimethoxysilane, vinyl methoxysilane, vinyl triethoxysilane, vinyl triacetoxysilane, dimethyl vinyl chlorosilane, divinyl chlorosilane, γ-methacryloxy propyl trimethoxysilane, hexamethyldisilane, trimethylsilane, trimethylchlorosilane, dimethyldichlorosilane, methyl trichlorosilane, allyl dimethyl chlorosilane, allyl phenyl dichlorosilane, benzyl dimethyl chlorosilane, bromomethyl dimethyl chlorosilane, α-chlorethyl trichlorosilane, β-chloroethyl trichlorosilane, chloromethyl dimethyl chlorosilane, triorganosilyl mercaptan, trimethylsilyl mercaptan, triorganosilyl acrylate, vinyl dimethyl acetoxysilane, dimethyl ethoxysilane, trimethyl ethoxysilane, trimethyl methoxysilane, methyl triethoxysilane, isobutyl trimethoxysilane, dimethyl dimethoxysilane, diphenyl diethoxysilane, hexamethyldisiloxane, 1,3-divinyl tetramethyldisiloxane, 1,3-diphenyltetramethyldisilioxane, dimethyl polysiloxane which contains 2 to 12 siloxane units per molecule and which contains, in a tail-positioned unit, no or one hydroxyl group, each of which is bonded to Si, etc., Moreover, it includes silicone oil such as dimethyl silicone oil. These may be used alone or in combination.

A number average particle diameter of the fluidity improving agent is preferably 5-100 nm, and more preferably 5-50 nm.

A unit average particle diameter of the flowability improving agent is preferably 5-100 nm and more preferably 5-50 nm.

A relative surface area using nitrogen adsorption measured by a BET method, is preferably no less than 30 $m^2/g$ and more preferably 60-400 $m^2/g$.

The surface processed fine powder is preferably no less than 20 $m^2/g$ and more preferably 40-300 $m^2/g$. Dosage of the fine powder is preferably 0.03-8 parts by weight relative to 100 parts by weight of toner particle.

Moreover, to the toner of the present embodiment, other additives may be added as needed, including inorganic fine powder of alumina, aluminum oxide, titanium oxide, etc., and tin oxide, zinc oxide, carbon black, antimony oxide, etc., as conductivity providing agent, and various types of metallic soaps, fluorine surfactant, phthalic acid dioctyl for purposes of protecting electrostatic latent image bearing body/carrier, improving cleanability, adjusting thermal, electrical and physical properties, adjusting resistance, adjusting softening point, improving fixing rate, etc. The inorganic fine powder may be hydrophobed as needed. Furthermore, lubricant such as polyvinylidene fluoride, stearic acid zinc, polytetrafluoroethylene, abrasive such as titanic acid strontium, cesium oxide, silicon carbide, etc., and caking inhibitor, as well as a black fine particle and a white fine particle of a polarity which is opposite that of a toner particle may be used in a small amount as a developability improvement agent.

For the purpose of controlling the charge amount, etc., these additives are also preferably processed with silicone varnish, various modified silicone varnishes, silicone oil, various modified silicone oils, silane coupling agent, silane coupling agent having a functional group, the treatment agents such as other organic silicon compounds, etc., or various types of treatment agents.

Moreover, when preparing a developing agent, an inorganic fine particle such as the forementioned hydrophobic silica fine powder, etc., may be added and blended in order to enhance the flowability, maintainability, developability, and transferability of the developing agent. For blending of an external additive, a common powder mixer may be appropriately selected and used, but it is preferably equipped with jackets, etc., to make it possible to control the internal temperature. In order to change the history of the load to be provided to the external additive, the external additive may be added on the way or gradually, rotational speed, time, temperature, the number of revolutions of the mixer, etc., may be changed, the load may be provided which is strong initially and relatively weak subsequently, or the other way around.

The mixer includes, for example, V type mixer, rocking mixer, Lodige mixer, Nauta mixer, Henschel mixer, etc.

A method of further adjusting the shape of the toner is not specifically limited, so that it may be appropriately selected depending on the purpose; the method includes, for example, a method of mechanically adjusting, using a hybridizer, mechano-fusion, etc., the shape of toner materials, including binder resin and coloring agent that are fused, blended, and then pulverized, a so-called spray-dry method of dissolving and dispersing a toner material in a solvent in which a toner binder is soluble, and then to remove the solvent therefrom using a spray-dry device to obtain a spherical toner, heating within an aqueous medium to produce a spherical shape, etc.

An inorganic fine particle may preferably be used as the external additive. The inorganic fine particle includes, for example, silica, alumina, titanium oxide, titanic acid barium, titanic acid magnesium, titanic acid calcium, titanic acid strontium, zinc oxide, tin oxide, silica sand, clay, mica, woodstone, diatomite, chromium oxide, cerium oxide, blood red, antimony trioxide, magnesium oxide, zirconium oxide, barium sulfate, barium carbonate, calcium carbonate, silicon carbide, silicon nitrate, etc. The primary particle diameter of the inorganic fine particle is preferably 5 μm-2 μm, and more preferably 5 μm-500 μm. The relative surface area by the BET method is preferably 20-500 $m^2/g$. The percentage of using the organic fine particle is preferably 0.01-5 weight % and more preferably 0.01-2.0 weight % of the toner.

In addition, the external additive includes polymer particle by polycondensed, thermally hardened resin such as silicone, Benzoguamine, nylon, etc., copolymer of acrylic acid ester, methacrylic acid ester, polystyrene obtained by soap-free emulsion, suspension polymerization, dispersion polymerization (i.e., polymer fine particle).

Such an external additive makes it possible to increase the hydrophobicity, and to prevent degradation of the external additive itself even under high humidity. The surface treatment agent preferably includes, for example, silane coupling agent, silinizing agent, silane coupling agent having fluorinated alkyl group, organic titanate coupling agent, aluminum coupling agent, silicone oil, modified silicone oil, etc.

A cleanability improving agent to be added to the toner in order to remove the developing agent after transferring that remains on a transfer belt as a primary transfer body or a photoreceptor as a latent image bearing body includes, for example, polymer fine particle produced by soap-free emulsification, including polystyrene fine particle, polymethyl methacrylate fine particle, alphatic acid metal salt such as stearic acid, stearic acid zinc, stearic acid calcium, etc. The polymer fine particle is comparatively narrow in grain distribution; the volume average particle diameter is preferably 0.01 μm-1 μm.

For the developing method using the toner including the various materials as described above, all electrostatic latent image bearing bodies used for related art electronic photography methods may be used; however, it is preferable to use, for example, organic electrostatic latent image bearing body, amorphous silica electrostatic latent image bearing body, selenium electrostatic latent image bearing body, zinc oxide electrostatic latent image bearing body, etc.

The present application is based on the Japanese Priority Application No. 2009-211773 filed on Sep. 14, 2009, the entire contents of which is hereby incorporated by reference.

The invention claimed is:

1. An image forming apparatus, comprising:

a toner image forming unit which forms a toner image on a surface of a transfer material, the toner image being an image formed of toner, the toner containing wax;

a fixing device which fixes the toner image using a fixing member on which a mold release agent including oil is applied; and a surface processing device which processes the fixed surface of the transfer material, on which surface the toner image is fixed using the fixing member on which the mold release agent including the oil is applied, wherein the surface processing device further includes a discharging unit which generates a discharge on or near the fixed surface of the transfer material, on which surface the fixed toner image is formed.

2. The image forming apparatus as claimed in claim 1, wherein an angle of contact of water relative to a portion on which the toner image exists, out of the surface of the transfer material that is processed with the discharge is not more than 90 degrees.

3. The image forming apparatus as claimed in claim 1, wherein an angle of contact of water relative to a portion on which the toner image exists, and an angle of contact of water relative to a portion on which the toner image does not exist, out of the surface of the transfer material that is processed with the discharge is not more than 90 degrees.

4. The image forming apparatus as claimed in claim 1, wherein the discharge is a discharge from which an atmospheric plasma is produced, an atmospheric glow discharge, a corona discharge, or a streamer discharge under atmospheric pressure.

5. The image forming apparatus as claimed in claim 4, wherein the surface processing device further includes a conveying belt which runs across multiple support rollers and which conveys the transfer material, wherein the discharging unit includes a conductive first electrode member which opposes, via an air gap, a surface on which is formed the toner image of the transfer material conveyed by the conveying belt and extends in a direction which crosses a moving direction of the transfer material, a second electrode member which is provided to oppose the first electrode member via a portion of the conveying belt that conveys the transfer material, and a voltage applying unit which applies a voltage between the conductive member of the second electrode member and the first electrode member.

6. The image forming apparatus as claimed in claim 1, wherein the discharge is a dielectric carrier discharge.

7. The image forming apparatus as claimed in claim 6, wherein the surface processing device further includes a conveying unit which conveys the transfer material, wherein the discharging unit includes a conductive first electrode member which opposes, via an air gap, a surface on which is formed the toner image of the transfer material conveyed by the conveying unit and extends in a direction which crosses a moving direction of the transfer material, a second electrode member, on the surface of which conductive member is formed a dielectric layer, that opposes the first electrode member via the transfer material, and a voltage applying unit which applies a voltage between the conductive member of the second electrode member and the first electrode member.

8. The image forming apparatus as claimed in claim 7, wherein the voltage is an alternating voltage with a frequency of between 20 KHz and 500 kHz.

9. The image forming apparatus as claimed in claim 8, wherein a peak-to-peak voltage value of the alternating voltage is between 5 $kV_{p-p}$ to 30 $kV_{p-p}$ per unit length (mm) of a thickness of the air gap.

10. The image forming apparatus as claimed in claim 7, wherein the first electrode member and the second electrode member each have a roller shape, and wherein a diameter of the second electrode member is larger than a diameter of the first electrode member.

11. The image forming apparatus as claimed in claim 10, wherein the surface processing device includes a drive unit which rotationally drives the second electrode member, and wherein the second electrode member has a whole of a peripheral direction of its external peripheral face covered with the dielectric layer.

12. The image forming apparatus as claimed in claim 7, wherein a relative permittivity of the dielectric layer of the second electrode member is between 2 and 10, and wherein the thickness of the dielectric layer is between 0.1 mm and 5 mm.

13. A surface processing device, included in an image forming system, that processes a surface of a transfer material, on which surface a toner image is fixed using a fixing member on which a mold release agent including an oil is applied, the toner image being an image formed of toner, the toner containing wax, the surface processing device comprising:

a discharging unit which generates a discharge on or near the fixed surface of the transfer material, on which surface the fixed toner image is formed; and a conveying unit which conveys the transfer material, wherein the discharging unit further includes a conductive first electrode member which opposes, via an air gap, a surface on which is formed the toner image of the transfer material conveyed by the conveying unit and extends in a direction which crosses a moving direction of the transfer material, a second electrode member, on the surface of which conductive member is formed a dielectric layer, that opposes the first electrode member via the transfer material, and a voltage applying unit which applies a voltage between the conductive member of the second electrode member and the first electrode member.

14. A transfer material processing apparatus which is included in an image forming system, the image forming system comprising an image forming apparatus having a toner image forming unit which forms a toner image on a surface of a transfer material and a fixing device which fixes the toner image using a fixing member on which a mold release agent which includes an oil is applied, the toner image being an image formed of toner, the toner containing wax, the transfer material processing apparatus to process the fixed transfer paper output from the image forming apparatus, the transfer material processing device comprising:

a transfer material input section into which is input the fixed transfer paper output from the image forming apparatus;

a surface processing device which processes the surface onto which is fixed a toner material of the transfer material which is input from the transfer material input section; and a transfer material output section from which the transfer material which is surface processed with the surface processing device is output, wherein the surface processing device further includes a discharge unit which produces a discharge on or near the fixed surface of the transfer material, on which surface a fixed toner image is formed.

15. An image forming system, comprising:

an image forming apparatus that includes a toner image forming unit which forms a toner image on a surface of a transfer material, the toner image being an image formed of toner, the toner containing wax, and a fixing device which fixes the toner image using a fixing member on which a mold release agent including oil is applied, and a transfer material processing device which processes fixed transfer paper output from the image forming apparatus, the transfer material processing device comprising:

a transfer material input section into which is input the fixed transfer paper output from the image forming apparatus;

a surface processing device which processes the surface onto which is fixed a toner material of the transfer material which is input from the transfer material input section; and a transfer material output section from which the transfer material which is surface processed with the surface processing device is output, wherein the surface processing device further-includes a discharge unit which produces a discharge on or near the fixed surface of the transfer material, on which surface a fixed toner image is formed.

* * * * *